US010499730B2

(12) United States Patent
Kim et al.

(10) Patent No.: US 10,499,730 B2
(45) Date of Patent: Dec. 10, 2019

(54) HEIGHT-ADJUSTABLE DESK

(71) Applicant: SAMHONGSA CO., LTD., Seoul (KR)

(72) Inventors: Jin Tae Kim, Seoul (KR); Jin Hyung An, Incheon (KR); Jeong Hyeon Hong, Seoul (KR); Woo Kee Min, Seoul (KR); Yong A. Park, Seoul (KR); Jong Sick Park, Seoul (KR)

(73) Assignee: SAMHONGSA CO., LTD., Seoul (KR)

( * ) Notice: Subject to any disclaimer, the term of this patent is extended or adjusted under 35 U.S.C. 154(b) by 58 days.

(21) Appl. No.: 15/512,947

(22) PCT Filed: Feb. 15, 2016

(86) PCT No.: PCT/KR2016/001477
§ 371 (c)(1),
(2) Date: Nov. 14, 2017

(87) PCT Pub. No.: WO2016/129971
PCT Pub. Date: Aug. 18, 2016

(65) Prior Publication Data

US 2018/0055214 A1 Mar. 1, 2018

(30) Foreign Application Priority Data

Feb. 13, 2015 (KR) ..... 10-2015-0022700
Mar. 11, 2015 (KR) ..... 10-2015-0034083
(Continued)

(51) Int. Cl.
*A47B 9/16* (2006.01)
*A47B 9/10* (2006.01)
(Continued)

(52) U.S. Cl.
CPC ..... *A47B 9/16* (2013.01); *A47B 9/02* (2013.01); *A47B 9/10* (2013.01); *A47B 9/18* (2013.01); *A47B 13/003* (2013.01); *A47B 21/02* (2013.01)

(58) Field of Classification Search
CPC .. F16M 11/046; F16M 11/38; F16M 2200/08; F16M 11/24; F16M 11/2014;
(Continued)

(56) References Cited

U.S. PATENT DOCUMENTS 3,282,566 A * 11/1966 Clarke ..... A47B 9/18 108/147
4,295,571 A * 10/1981 Meyer ..... B42F 15/0094 108/118
(Continued)

FOREIGN PATENT DOCUMENTS

DE 9011551 U1 11/1990
FR 1358447 2/1963
(Continued)

OTHER PUBLICATIONS

Office Action for corresponding Korean application No. KR 10-2017-0141174, dated Dec. 20, 2017.
(Continued)

*Primary Examiner* — Janet M Wilkens
(74) *Attorney, Agent, or Firm* — Novick, Kim & Lee, PLLC; Sang Ho Lee

(57) ABSTRACT

A height-adjustable desk includes a base, a top board, a link mechanism, a height-adjusting member, and an operating member. The top board is configured to be vertically elevated with respect to the base. The link mechanism is disposed between the base and the top board so as to support the top board such that the top board may be elevated, the link mechanism including a plurality of link members. The
(Continued)

height-adjusting member is formed to be extendable at a desired length and determining a height of the top board with respect to the base according to a length thereof. The operating member fixes the height-adjusting member so that the height-adjusting member maintains the desired length.

6 Claims, 26 Drawing Sheets

(30) Foreign Application Priority Data

Nov. 10, 2015 (KR) ..... 10-2015-0157727
Nov. 10, 2015 (KR) ..... 10-2015-0157731
Nov. 10, 2015 (KR) ..... 10-2015-0157733
Nov. 10, 2015 (KR) ..... 10-2015-0157737

(51) Int. Cl.
*A47B 9/18* (2006.01)
*A47B 21/02* (2006.01)
*A47B 9/02* (2006.01)
*A47B 13/00* (2006.01)

(58) Field of Classification Search
CPC ..... F16M 11/2092; F16M 2200/004; F16M 2200/063; A47B 2021/0335; A47B 3/00; A47B 9/16; A47B 9/10; A47B 21/02; A47B 21/0073; A47B 21/0314; A47B 2200/0056; A47B 2200/0046; A47B 5/006; A47B 5/04; B66F 7/0609; B66F 7/065
USPC ..... 108/136, 50.01, 50.02, 145, 147, 144.11, 108/93, 96, 116–118, 120, 43, 138, 33, 108/39, 14, 146; 312/306, 312, 208.1, 312/223.3, 196; 248/157, 277, 575, 588, 248/631, 164, 432, 439, 188.2, 550, 421, 248/562, 431, 280.11, 292.11, 919, 920, 248/923; 254/122
See application file for complete search history.

(56) References Cited

U.S. PATENT DOCUMENTS 4,403,680 A * 9/1983 Hillesheimer ..... B66F 7/065 177/146
4,544,203 A * 10/1985 Younger ..... A47G 9/1009 108/118
4,574,785 A * 3/1986 Yamamoto ..... A61G 7/05746 137/624.11
4,577,821 A * 3/1986 Edmo ..... B66F 7/08 108/145
4,741,512 A * 5/1988 Elkuch ..... B66F 7/065 248/421
5,400,720 A * 3/1995 Stevens ..... A47B 9/16 108/147
5,460,460 A * 10/1995 Alexander ..... B65G 69/2823 14/71.3
5,695,173 A * 12/1997 Ochoa ..... B66F 7/065 254/10 C
5,778,799 A 7/1998 Eyre
5,823,120 A * 10/1998 Holmquist ..... A47B 9/02 108/147
5,927,679 A * 7/1999 Hill ..... B60N 2/502 248/421
5,967,494 A * 10/1999 Fiorese ..... B66F 7/08 254/122
7,070,189 B2 * 7/2006 Grauss ..... B25H 5/00 108/147
8,015,638 B2 * 9/2011 Shimada ..... A47C 19/04 108/145
8,065,966 B1 11/2011 Bacon et al.
9,055,810 B2 * 6/2015 Flaherty ..... A47B 9/18
2004/0065238 A1 * 4/2004 Chen ..... A47B 9/10 108/147
2009/0078509 A1 * 3/2009 Olsen ..... B66F 7/065 187/211
2010/0012909 A1 * 1/2010 Lee ..... B66F 7/065 254/93 R
2017/0340104 A1 * 11/2017 Chuang ..... A47B 9/16
2018/0103752 A1 * 4/2018 Zhong ..... A47B 3/02

FOREIGN PATENT DOCUMENTS

JP H07155226 A 6/1995
JP H09121971 A 5/1997
JP 2557131 Y 8/1997
JP 10-262741 A 10/1998
JP 10-272015 A 10/1998
JP 11-103647 A 4/1999
JP 11-318581 A 11/1999
JP 2002-306249 A 10/2002
JP 2006296631 A 11/2006
JP 2007-037926 A 2/2007
JP 2011031018 A 2/2011
KR 10-1998-0056758 A 9/1998
KR 20-0291352 Y1 10/2002
KR 20050103154 A 10/2005
KR 2012-0009752 A 2/2012
KR 10-1385575 B1 4/2014
KR 10-2014-0074679 A 6/2014
WO 2015177233 * 11/2015
WO 2017045506 * 3/2017

OTHER PUBLICATIONS

Korean Office Action for corresponding Korean Application No. 9-5-2018-058667401, dated Aug. 29, 2018.
Search Report for corresponding European application No. 16749511.8 dated May 24, 2018.
International Search Report for Application No. PCT/KR2016/001477 dated Jun. 23, 2016.

* cited by examiner

HEIGHT-ADJUSTABLE DESK

RELATED APPLICATIONS

The present invention is a U.S. National Stage under 35 U.S.C. 371 patent application, claiming priority to Serial No. PCT/KR2016/001477, filed on 15 Feb. 2016; which claims priority of KR 10-2015-0022700, filed on 13 Feb. 2015; KR 10-2015-0034083, filed on 11 Mar. 2015; KR 10-2015-0157733, filed on 10 Nov. 2015; KR 10-2015-0157737, filed on 10 Nov. 2015; KR 10-2015-0157727, filed on 10 Nov. 2015; and KR 10-2015-0157731, filed on 10 Nov. 2015, the entirety of all of which are incorporated herein by reference.

TECHNICAL FIELD

Exemplary embodiments of the present invention relate to a height-adjustable desk.

BACKGROUND ART

Companies, schools, or the like have desks which are convenient for people to do work or education with computers and books along with chairs that people sit on. The existing desks are made to have a uniformly constant height, and therefor have no separate function of adjusting the height.

People who do work or take a class in the space spend most of their time sitting on the desks, which results in scoliosis that a spine is curved or increasingly receive mental and physical stresses such as an eye strain that is caused due to a focus mismatch between a book on a desk and eyes. As a result, there is a problem that it is difficult to efficiently do work because a healthy mind and physical growth are adversely affected.

By considering the above problems in recent years, a desk which may be used in a standing state by coupling a support having a relatively longer length on a bottom surface of a top board on which a computer and a book are placed is becoming popular. However, there is a limitation of solving the above problems with the desk since people who do work standing up for long period of time are more tired.

Taking a rest such as regular stretching and exercise from sitting for a long period of time may bring positive results to a body or mind, but there are many limitations in taking a rest when considering situations of modern people of doing heavy work. Therefore, an ergonomic desk which may continuously do work while considering a user's health is required.

In response to the demands, various types of height-adjustable desks have recently been introduced. Some of the height-adjustable desks are formed so that the entire desk moves up and down by using a motor or the like. However, the height-adjustable desk requires an actuator such as a motor, and therefore increases manufacturing costs and has a complicated structure.

DISCLOSURE

Technical Problem

An object of the present invention is to provide a desk having a simpler structure than the existing desk and enabling a user to easily adjust a height of a top board.

Technical Solution

In accordance with one aspect of the present invention, a height-adjustable desk includes: a base; a top board provided so as to move up and down with respect to the base; a link mechanism disposed between the base and the top board so as to support a top board such that the top board may move up and down and including a plurality of link members; a height-adjusting means formed to be extendable at a desired length and determining the height of the top board with respect to the base according to a length thereof; and an operating means for fixing the height-adjusting means so that the height-adjusting means maintains the desired length.

BEST MODE

Figure 1:
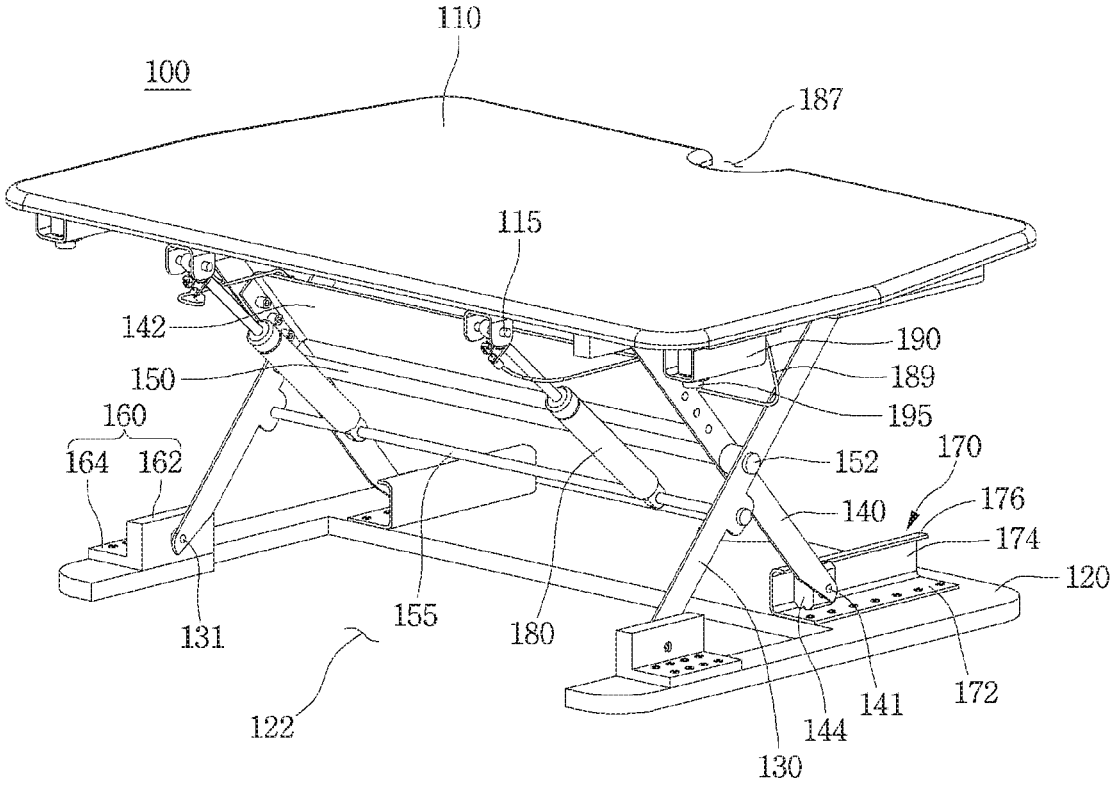
FIG. 1 is a perspective view illustrating a height-adjustable desk according to a first embodiment of the present invention.

Hereinafter, detailed embodiments of the present invention will be described in detail with reference to the accompanying drawings.

Hereinafter, embodiments of the present invention will be described in more detail with reference to the accompanying drawings. The same reference numerals will be used to describe the same or like components, independent of the reference numerals and an overlapped description of the same components will be omitted. Terms "units" for components used in the following description are used only in order to easily make a specification. Therefore, the above-mentioned terms do not have meanings or roles that distinguish from each other in themselves. Further, in describing the embodiments of the present invention, when it is determined that the detailed description of the known art related to the present invention may obscure the gist of the present invention, the detailed description thereof will be omitted. Further, the accompanying drawings are provided to easily understand the technical spirit of the present invention disclosed in the present specification, and therefore the technical spirit is not limited to the accompany drawings. Therefore, it is to be construed that the accompanying drawings include all modifications, equivalents, and replacements included in the technical spirit and the technical scope disclosed in the present specification.

Figure 2:
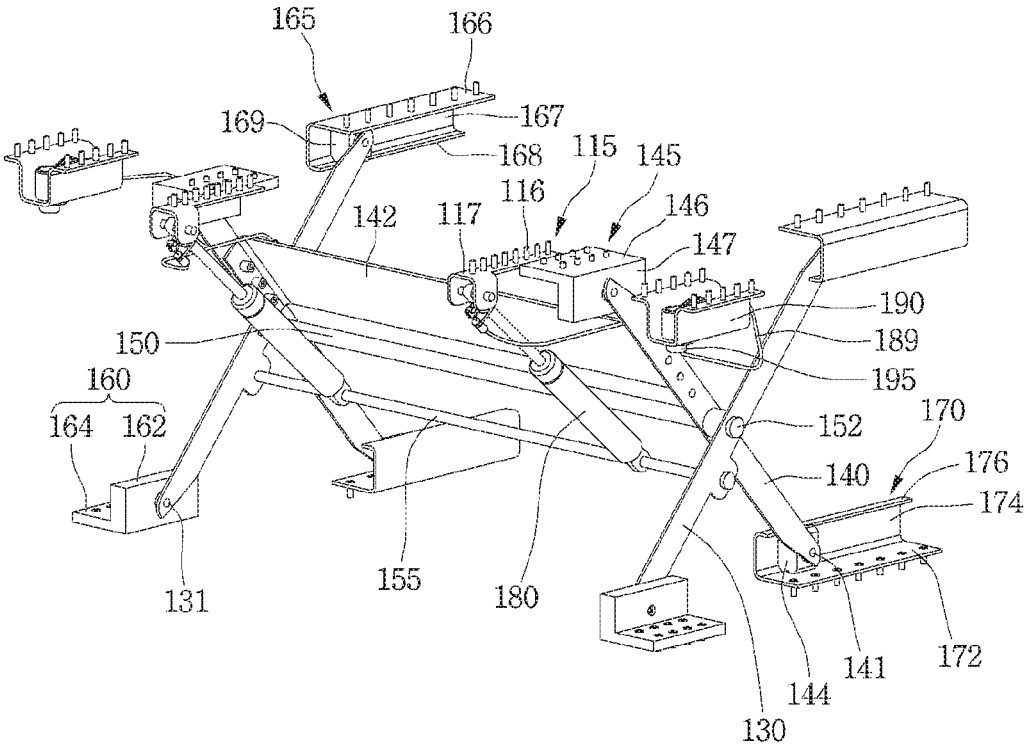
FIG. 2 is a perspective view illustrating the height-adjustable desk in which a top board and a base are separated.
Figure 3:
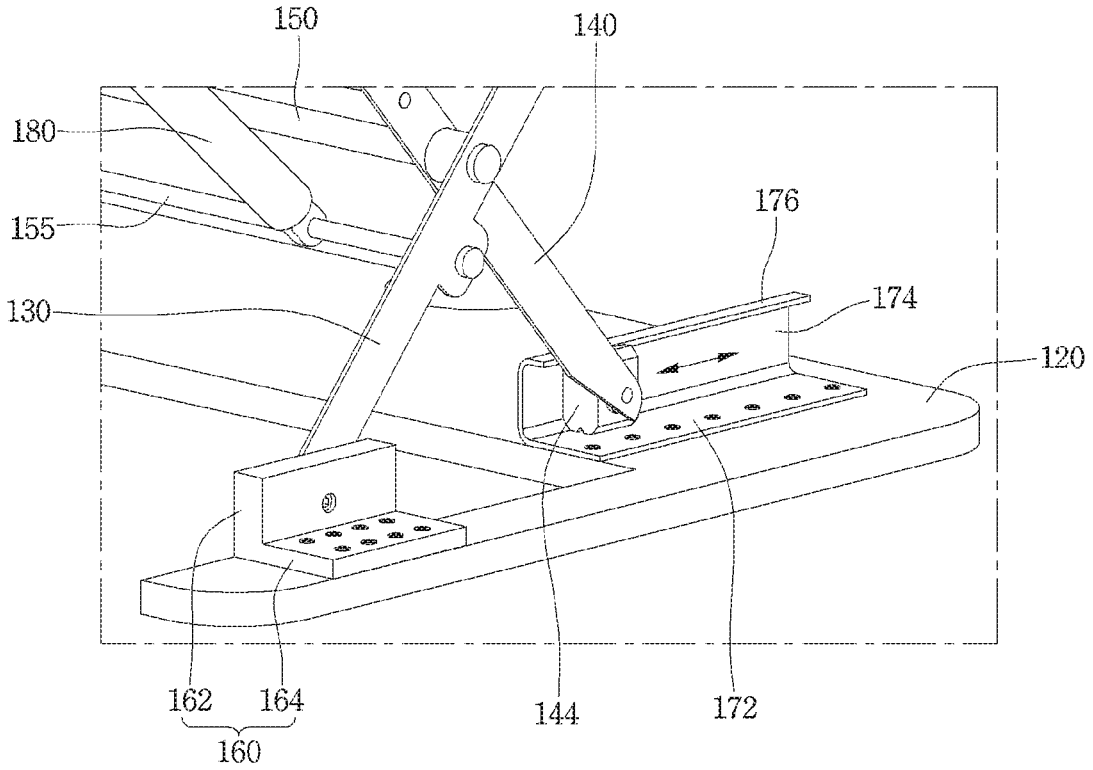
FIG. 3 is an enlarged perspective view of part A of FIG. 1.

FIG. 1 is a perspective view illustrating a height-adjustable desk according to a first embodiment of the present invention, FIG. 2 is a perspective view illustrating the height-adjustable desk in which a top board and a base are separated, and FIG. 3 is an enlarged perspective view of part A of FIG. 1.

Referring to FIGS. 1 to 3, a height-adjustable desk 100 according to a first embodiment of the present invention may include a base 120 and a top board 110.

The base 120 may form a lower portion of the height-adjustable desk 100 and may support the height-adjustable desk 100 by contacting a lower surface thereof with a ground or a bottom surface. A depression groove 122 depressed backward by a predetermined distance may be formed at a front of the base 120. The depression groove 122 may accommodate some of a user's body and a user may get closer to the height-adjustable desk 100 when he/she is positioned at a front of the height-adjustable desk 100.

The top board 110 is formed in substantially a plate shape. In some cases, the top board 110 may be formed to correspond to the cross-sectional shape of the base 120 including the depression groove 122. Task or learning tools of a user may be placed on an upper surface of the top board 110. For example, various tools such as a monitor, a book, and a keyboard may be placed on an upper surface of the top board 110.

Further, a rear portion of the top board 110 may be provided with a wiring accommodating groove 187 which is depressed forward. The wiring accommodating groove 187 may be provided on the top board 110 by partially recessing the rear portion of the top board 110 inwardly. The wire accommodating groove 187 may receive some of the task tools placed on the top board 110. For example, when a computer monitor is placed on the top board 110, a wiring for providing power to the computer monitor may be received in the wiring accommodating groove 187 to be more neatly arranged.

The height-adjustable desk may include a height-adjusting means for connecting between the top board 110 and the base 120 and adjusting the height of the top board 110 with respect to the base 120.

The height-adjusting means may be provided under the top board 110. The height-adjusting means may be disposed between the base 120 and the top board 110.

The height-adjusting means may include a link mechanism disposed between the base 120 and the top board 110 to elevatably support the top board 110. The height-adjusting means may include a driving source for pressing the top board 110 in a direction in which the top board 110 rises during a user's operation.

The height-adjusting means may include a plurality of connection members 130 and 140 for relatively moving the top board 110 with respect to the base 120. The connection member has a rod shape in which the base 120 and the top board 110 are rotatably mounted at both ends thereof. The plurality of connection members 130 and 140 may move the top board 110 up and down so that a distance between the top board 110 and the base 120 is changed.

The plurality of connection members 130 and 140 may be provided on both sides between the top board 110 and the base 120, respectively. In some cases, the plurality of connection members may also be provided on front and rear surfaces between the top board 110 and the base 120, respectively. This will be described below. The plurality of connection members 130 and 140 include the first connection member 130 extending from a bottom surface of a rear side of the top board 110 toward an upper surface of a front side of the base 120 and the second connection member 130 extending from a bottom surface of a front side of the top board 110 toward an upper surface of a rear side of the base 120. The first connection member 130 and the second connection member 140 may be disposed to intersect each other between the top board 110 and the base 120. The first connection member 130 and the second connection member 140 may be disposed in substantially an 'X' shape when viewed from the side.

The first connection member 130 has one end coupled to a first coupling part 160 provided on the upper surface of the front side of the base 120 and the other end coupled to a first moving part 169 slidably moving on a first slide guide 165 on a bottom surface of the rear side of the top board 110. The first coupling part 160 and the first slide guide 165 are provided on both sides of the upper surface of the base 120 and the bottom surface of the top board 110, respectively, corresponding to the number of first connection members 130.

The first coupling part 160 includes a first horizontal part 164 having a lower surface coupled to the upper surface of the base 120 by a screw or a link and a first vertical part 162 extending upward from one side of the first horizontal part 164 to be coupled to one end of the first connection member 130. Further, one end of the first connection member 130 is rotatably hinged to a side surface of the first vertical part 162. That is, one end of the first connection member 130 is rotatably coupled by the hinge pin 131 passing through the first vertical portion 162 from the first connection member 130. In some cases, one end of the first connection member 130 may be directly hinged to the base without the first coupling part.

The first slide guides 165 are provided on both sides of the lower surface of the rear side of the top board 110, respectively. The first slide guide 165 includes a first upper surface part 166 having an upper surface coupled to the lower surface of the top board 110, a first side surface part 167 extending downward from one side of the first upper surface part 166, and a first lower surface part 168 extending inwardly from an end of the first side surface part 167. A cross-section shape of the first slide guide 165 has a box shape whose one side surface is open by the first upper surface part 166, the first side surface part 167 and the first lower surface part 168. Further, an outer surface of the first moving part 169 may slidably move while contacting a space formed by the first upper surface part 166, the first side surface part 167, and the first lower surface part 168 of the first slide guide 165.

The other end of the first connection member 130 is hinged to the side surface of the first moving part 169, and thus a slope of the first connection member 130 is changed when the first moving part 169 slid along the first slide guide 165. In other words, an angle formed by the first connection member 130 and the top board 110 and the base 120, respectively, is changed through a hinge connection with the first vertical part 162 and a hinge connection with the first moving part 169. As illustrated in FIG. 2, when the angle formed by the first connection member 130 and the base 120 is relatively larger, the first moving part 169 is positioned to be close to a front of the first slide guide 165 and when the angle formed by the first connection member 130 and the base 120 is relatively smaller, the first moving part 169 is positioned to be close to the rear of the first slide guide 165. One end of the first connection member 130 may rotate by the first coupling part 160 as soon as the other end of the first connection member 130 slidably moves.

The second connection member 140 has one end coupled to a second coupling part 145 provided on the lower surface of the front side of the top board 110 and the other end coupled to a second moving part 144 slidably moving on a second slide guide 170 on the upper surface of the rear side of the base 120. The second coupling part 145 and the second slide guide 170 are provided on both sides of the upper surface of the base 120 and the bottom surface of the top board 110, respectively, corresponding to the number of second connection members 140.

The second coupling part 145 includes a second horizontal part 146 having an upper surface coupled to the lower surface of the top board 110 by a screw or a link and a second vertical part 147 extending downward from one side of the second horizontal part 146 to be coupled to one end of the second connection member 140. Further, one end of the second connection member 140 may be rotatably hinged to a side surface of the second vertical part 147. That is, one end of the second connection member 140 is rotatably coupled by the hinge pin passing through the second vertical part 147 from the second connection member 140.

The second slide guides 170 are provided on both sides of the upper surface of the rear side of the base 120, respectively. The second slide guide 170 includes a second lower surface part 172 having a lower surface coupled to the upper surface of the top board 110, a second side surface part 174 extending upward from one side of the second lower surface part 172, and a second upper surface part 176 extending outwardly from an end of the second side surface part 174. A cross-section shape of the second slide guide 165 has a box shape whose one side is open by the second lower surface part 172, the second side surface part 174, and the second upper surface part 176. Further, the second slide guide 170 is provided with the second moving part 144 so that the second moving part 144 slidably moves a space formed by the second lower surface part 172, the second side surface part 174, and the second upper surface part 176.

The other end of the second connection member 140 is hinged to the side surface of the second moving part 144, and thus a slope of the second connection member 140 is changed when the second moving part 144 slid along the second slide guide 170. In other words, an angle formed by the second connection member 140 and the top board 110 and the base 120, respectively, is changed through a hinge connection with the second vertical part 147 and a hinge connection with the second moving part 144. As illustrated in FIG. 2, when the angle formed by the second connection member 140 and the base 120 is relatively larger, the second moving part 144 is positioned to be close to a front of the second slide guide 170 and when the angle formed by the second connection member 140 and the base 120 is relatively smaller, the second moving part 144 is positioned to be close to the rear of the first slide guide 170. The one end of the second connection member 140 may rotate by the second coupling part 145 as soon as the other end of the second connection member 140 slidably moves.

The first and second coupling parts 160 and 145 may be formed to be symmetrical to each other on the lower surface of the top board 110 and the upper surface of the base 120 and the first slide guide 165 and the second slide guide 170 may be provided to be symmetrical to each other on the lower surface of the top board 110 and the upper surface of the base 120.

Meanwhile, a rotating shaft 150 forming a rotation center is fitted in a region where the first connection member 130 and the second connection member 140 intersect each other. More specifically, both ends of the rotating shaft 150 each may be fitted in the region where the plurality of connection members 130 and 140 disposed at both sides intersect each other. For this purpose, the region where the first connection member 130 and the second connection member 140 are formed with through holes (not illustrated) corresponding to each other so that the rotating shaft 150 is fitted in the region where the first connection member 130 and the second connection member 140 intersect each other and both ends of the rotating shaft 150 are fixed by being fitted in the through holes. Accordingly, the first connection member 130 and the second connection member 140 may relatively rotate to each other through the rotating shaft 150. In other words, the rotating shaft 150 may form a central axis of an 'X' shape formed by the first connection member 130 and the second connection member 140.

Meanwhile, the first and second connection members are not necessarily limited to the illustrated shapes, and two connection members may be arranged to be parallel to each other. In this case, both ends of the two connection members are hinged to the top board and the base, respectively, and the slide guide is omitted.

Further, the first connection members 130 disposed at both sides of the height-adjustable desk 100, respectively, may be provided with a connection member connector (not illustrated) that connects the plurality of first connection members 130 so that the plurality of first connection members 130 may be operated in parallel. According to the present embodiment, a coupling shaft 155 connected to inner side surfaces of the plurality of first connection members 130 may serve as the connection member connector.

Further, the plurality of second connection members 140 disposed at both sides of the height-adjustable desk 100, respectively, may be provided with a connector 142 that connects the plurality of second connection members 140 so that the plurality of second connection members 140 may be operated in parallel.

Here, the connector 142 and the coupling shaft 155 have both ends coupled between the pair of first and second connection members 130 and 140, and thus the top board maintains a parallel state with respect to the base while the movement of the two first connection members 130 or the movement of the second connection member 140 is synchronized. Further, the coupling shaft and the connector may also serve as a reinforcing member for increasing rigidity of the link mechanism.

Further, in the embodiment, the pair of first and second connection members may be disposed on a left surface of the top board and another pair of first and second connection members may be disposed on a right surface, but the embodiment of the present invention may also consider an example in which the pair of first and second connection members is disposed on front and rear surfaces.

Further, both of the first and second connection members need not be provided, and therefore one of the first and second connection members may be omitted and may serve as the connection member from which the height-adjusting mechanism is omitted. Specifically, the example in which the second connection member is omitted and the height-adjusting mechanism is disposed to intersect the first connection member in an X letter may be considered.

Figure 4:
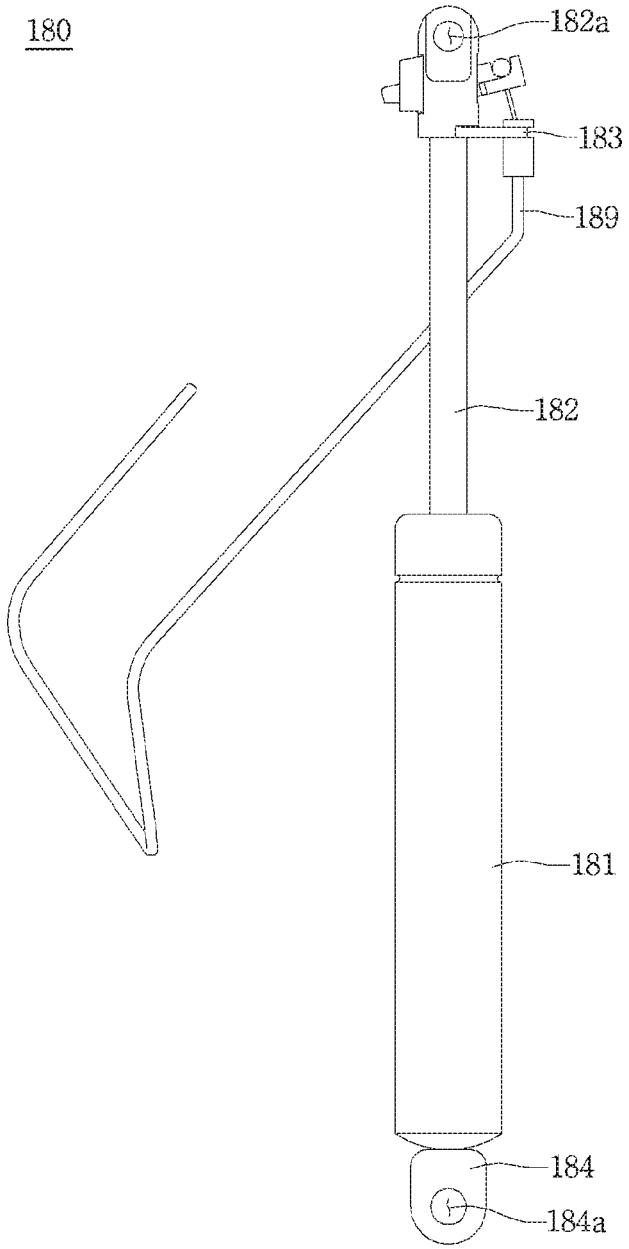
FIG. 4 is a side view for explaining a height-adjusting mechanism according to the first embodiment of the present invention.

FIG. 4 is a side view for explaining a height-adjusting mechanism according to the first embodiment of the present invention.

Referring to FIGS. 1 and 4, the height-adjustable desk 100 may include a height-adjusting mechanism 180 installed to change a height of the top board 110. The height-adjusting mechanism 180 may include at least one of a gas cylinder (spring) and a hydraulic cylinder.

The plurality of first connection members 130 may be positioned opposite to each other and both ends of the coupling shaft 155 are fitted in the plurality of first connection members 120. The coupling shaft 155 may be configured such that an end of the height-adjusting mechanism 180 to be described below is coupled, horizontally disposed between the inner side surfaces of the plurality of first connection members 130, and is fixed by being fitted in the plurality of first connection members 130.

Further, the lower surface of the front side of the top board 110 is provided with a height-adjusting mechanism coupling part 115 in which another end of the height control mechanism 180 is fitted. The height-adjusting mechanism coupling part 115 may be disposed to be close to a front end of the lower surface of the top board 110. Specifically, the height-adjusting mechanism coupling part 115 may include a coupling part body 116 coupled to the lower surface of the top board 110 and a coupling part extending body 117 provided with a shaft that extends downward from one side of the coupling part body 116 and has an end of the height-adjusting mechanism 180 passing therethrough. The plurality of height-adjusting mechanism coupling parts 115 may each be provided to be symmetrical to each other with respect to the center.

Further, to adjust the height of the top board 110, the height-adjusting mechanism 180 having one end fitted in the height-adjusting mechanism coupling parts 115 and the other end fitted in the coupling shaft 155 is provided. As illustrated in FIG. 4, the height-adjusting mechanism 180 includes a hollow tube-shaped cylinder 181 and a piston rod 182 inserted into a hollow portion in the cylinder 181. Further, a hole 184*a* is formed in the coupling part 184 disposed at a lower portion of the cylinder 181, and thus the coupling shaft 155 passes through the hole 184*a* to fix the other end of the height-adjusting mechanism 180. Further, the upper portion of the piston rod 182 is provided with a hole 182*a* through which the shaft provided on the coupling part extending body 117 passes and the shaft of the coupling part extending body 117 passes through the hole 182*a* to fix one end of the height-adjusting mechanism 180.

Meanwhile, the height-adjusting mechanism 180 is configured so that a length of the piston rod 182 protruding from the cylinder may be changed while the piston rod 182 slides in the cylinder 181. That is, gas is injected into the cylinder 181, and the injected gas exerts a damping force by applying a pressure to the piston rod 182 to block the movement of the piston rod 182. Although not illustrated, an upper side of the piston rod 182 is provided with a gas opening/closing pin for selectively opening and closing internal gas and an opening/closing guide for operating the gas opening/closing pin, and one end of a cable 189 is connected to the opening/closing guide. Therefore, the gas in the height-adjusting mechanism 180 is in a movable state by an operation of pulling the cable 189. In this state, the piston rod 182 may move up and down.

Specifically, the inside of the piston rod and the cylinder are provided with a space charged with gas and a gas channel through which the gas moves and the charged gas may be in the movable state or maintained in the stopped state depending on the position of the gas opening and closing pin. When the piston rod moves, the gas charged therein should also move. Accordingly, the piston rod may also move only when the gas is in the movable state, and the piston rod is also maintained in the stopped state when the gas is maintained in the stopped state. Therefore, the piston rod may be in the movable state or the stopped state depending on the position of the gas opening/closing pin.

At this point, the gas injected into the cylinder continuously applies a pressure to the piston rod during the movement of the piston rod. Therefore, even if the cable 189 is pulled and thus the piston rod may be in the movable state, the piston rod is supported by an appropriate damping force. This damping force supports loads of various articles stood on the top board during the adjustment of the height of the top board. As a result, the user does not have to support the top board with his own force in during the adjustment of the height of the top board, such that he/she may easily perform the rising or falling of the top board without great power.

Further, when the force to pull the cable 189 is released, the gas in the cylinder is in the state in which it is impossible to move, and thus the piston rod is also kept stationary without movement.

Here, the pressure of the gas injected into the cylinder may be appropriately adjusted according to the application in which the desk is used, the size of the desk, and the like. For example, the larger the top board, the larger the number of articles to be stood and the larger the allowable load. Therefore, the pressure in the cylinder may also be increased according to the increased allowable load.

Meanwhile, only gas may be injected into the cylinder alone, but gas and oil may be injected together. For example, the cylinder may be filled with nitrogen gas and oil together, which serves to minimize the vibration of the top board by using the oil which is an incompressible fluid immediately after the force is applied to the top board or when the top board is stopped at a desired position.

Meanwhile, the cable 189 is connected to a button part 195 provided on the bottom surface of the top board. That is, the cable 189 is pulled by an operation of the button part 195, and thus the top board may be switched to a height-adjustable state.

The button part 195 is provided in operating parts 190 each disposed on both sides of the lower portion of the top board 110 as illustrated. In the illustrated example, the two height-adjusting mechanisms 180 are provided, and therefore the operating part and the button part each are also provided two by two. That is, although the operating part and the button part may be provided in the same number as the number of height-adjusting mechanisms, in some cases, the example in which more than two cables are fixed to one button part may also be considered.

Hereinafter, the process of adjusting the height of the height-adjustable desk 100 will be described.

Figure 5:
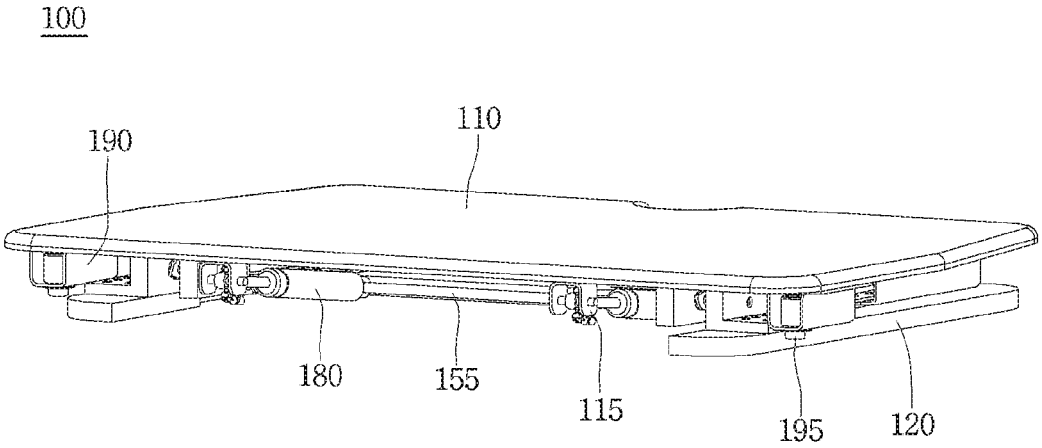
FIG. 5 is a perspective view illustrating an appearance in which a top board according to the first embodiment of the present invention moves downward.

FIG. 5 is a perspective view illustrating an appearance in which the top board according to the first embodiment of the present invention moves downward.

Referring to FIGS. 1 and 5, the height of the top board 110 of the height-adjustable desk 100 according to the first embodiment of the present invention is changed. As the use example, the height-adjustable desk 100 may be used while being placed on an upper surface of another height-adjustable desk. At this point, if the top board 110 is positioned to be close to the base 120 as illustrated in FIG. 5, the user will work while sitting. Further, when the top board 110 moves upward as illustrated in FIG. 1, the user may take a state in which he/she stands positioning the top board at an eye level.

Describing in detail the operation process, if the user presses the button part 195, the gas opening/closing pin moves by the cable 189. As a result, the gas channel in the cylinder is open and thus the gas is in a movable state, such that the piston rod may also move. Therefore, the user may adjust the height of the top board.

Specifically, when the height of the top board 110 intends to be increased, the top board 110 rises with a force in the state in which the button part 195 is pressed. In this case, since the damping force is applied to the piston rod as described above, most of the load of the top board is offset by the damping force, such that the user may smoothly lift up the top board even with a small force. If the load of the article stood on the top board is small or the gas pressure in the cylinder is set to be large, the top board may also rise by itself by the damping force even if only the button part is pressed.

Meanwhile, when the height is lowered, the top board 110 is pressed downward in the state in which the button part 195 is pressed. In this case, the top board is supported by the damping force, and therefore the user need not support the load of the top board, such that the top board may easily move.

The height of the height-adjusting mechanism 180 is changed by the operation of the user and the first moving part 169 and the second moving part 144 each may slidably move by the first slide guide 165 and the second slide guide 170. When the pressing force applied to the button part 195 is released, the height-adjusting of the top board 110 may be stopped even during the movement. Thus, the height of the top board 110 may be fixed at any position between the heights illustrated in FIGS. 1 and 5.

Describing the example in which the top board 110 moves downward, the length of the height-adjusting mechanism 180 is shortened by the downward pushing force of the user and the second moving part 144 moves backward on the second slide guide 170. Further, the upper ends of the first connection member 130 and the second connection member 140 move downward so that the angle formed with the base 120 becomes smaller.

As described above, the height of the top board 110 may be adjusted only by a simple operation of the operation of the button part 195, thereby improving the user's convenience. In addition, the user sitting for a long period of time may do more active work by variously adjusting the height of the top board 110.

Further in order to adjust the height of the top board as described above, there is a need to perform the operation of holding the top board and lifting up or pressing the top board. By disposing the position of the operating part including the button part on the lower surface of both sides of the top board, the operations of holding the top board and pressing the button part may be performed at a time. That is, since it is possible to hold the top board while pressing the button part, the user may freely adjust the height of the top board only by lifting up or lowering the top board without operating the button part separately.

In addition, since the piston rod of the height-adjusting mechanism and the button part provided on the operating part are connected by the cable, various mechanisms necessary for the operation may be freely disposed. That is, when the button part and the piston rod are fixed by a plurality of links having a fixed shape, there is a problem that the position of the button part is restricted and the structure is complicated. However, in the embodiment of the present invention, the button part and the piston rod are connected by a flexible cable, the degree of freedom in the disposition of the button part may be improved and the structure may be simplified.

Further, since the first and second connection members are disposed so as to form an X letter and an end of one side thereof is fixed to slid, the horizontal movement of the top board does not occur during the height-adjusting of the top board, thereby more improving the use convenience. That is, since the top board does not move forward and backward even while the top board moves up and down along the vertical direction, that is, the top board does not move toward the front or rear surface with respect to the user, occupancy of the space occupied by the desk may be minimized. For example, if the top board protrudes to the front during the rising, there is a need to secure a free space so that the user may retract as much. However, in the embodiment of the present invention, the clearance is not required and therefore the free space required to install and use a desk is minimized.

Figure 6:
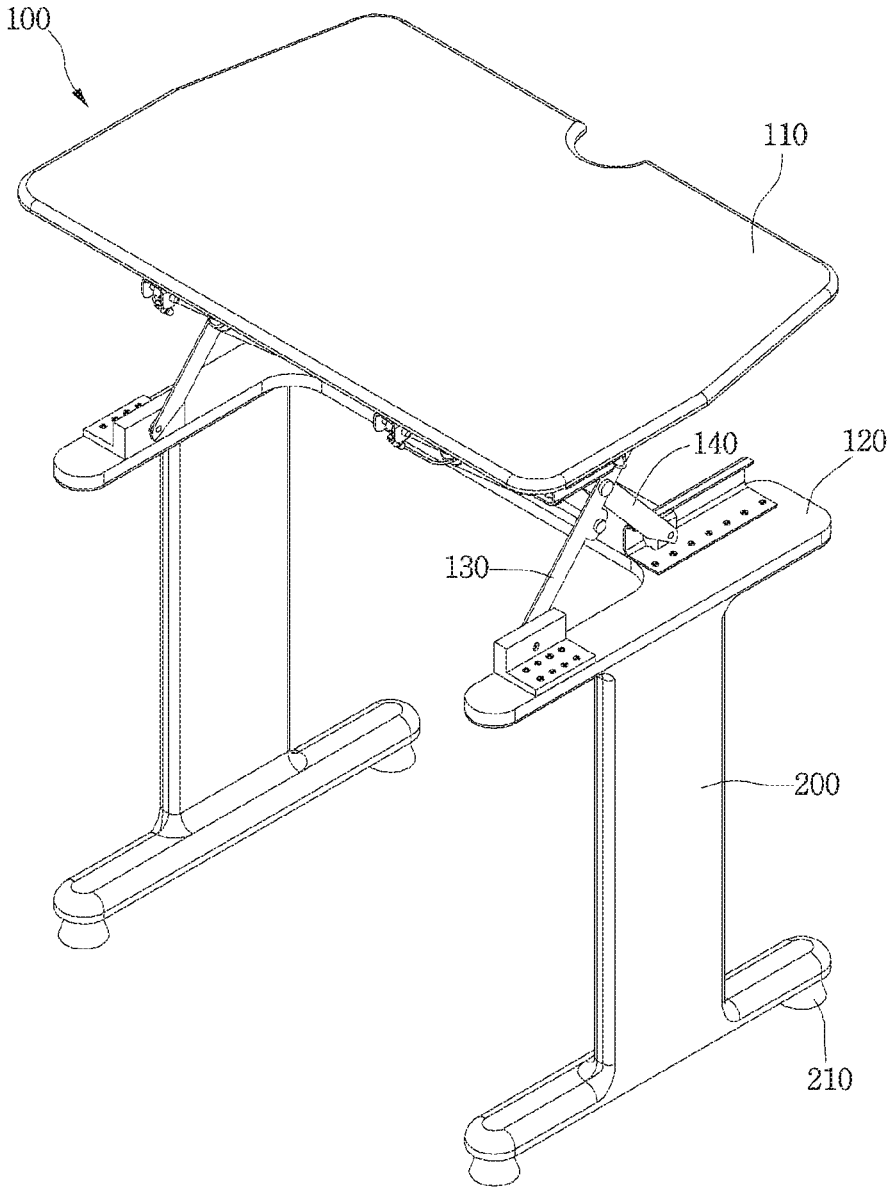
FIG. 6 is a perspective view illustrating an appearance in which the height-adjustable desk according to the first embodiment of the present invention is coupled to a fixed leg.
Figure 7:
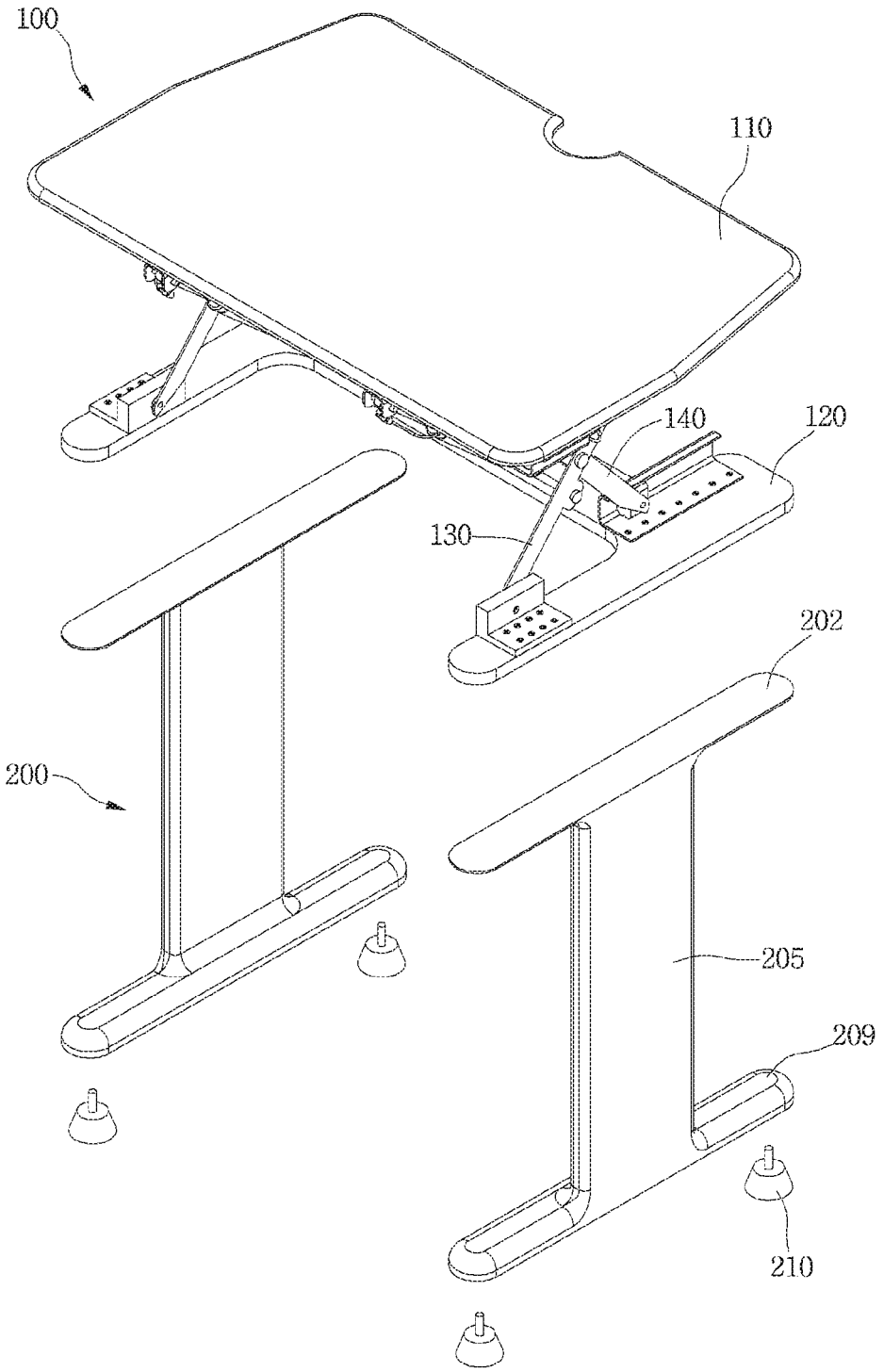
FIG. 7 is an exploded perspective view illustrating the height-adjustable desk according to the first embodiment of the present invention and the fixed leg.

FIG. 6 is a perspective view illustrating an appearance in which the height-adjustable desk according to the first embodiment of the present invention is coupled to a fixed leg and FIG. 7 is an exploded perspective view illustrating the height-adjustable desk according to the first embodiment of the present invention and the fixed leg.

Referring to FIGS. 6 and 7, a fixed leg 200 may be provided on the lower surface of the base 120 to support the height-adjustable desk 100 and to separate the height-adjustable desk 100 from the ground. As described above, the height-adjustable desk 100 may be used while being placed on an upper surface of another height-adjustable desk, but the another height-adjustable desk is required, and therefore the height-adjustable desk 100 may be used alone by using the fixed leg 200. That is, in the first embodiment, the height-adjustable desk 100 is used in the state where it stands on the top board of the desk previously held by the user, and in the case of the embodiment illustrated in FIGS. 6 and 7, the height-adjustable desk 100 may be configured to be used alone without being stood thereon.

The fixed leg 200 includes a base coupling part 202 coupled to the bottom surface of the base 120, a leg coupling part 209 to which a leg 210 separating the fixed leg 200 on the lower surface from the ground is coupled, and a fixed leg body 205 connecting between the base coupling part 202 and the leg coupling part 209.

The cross-sectional shape of the base coupling part 202 is formed to correspond to that of the bottom surface of the base 120 and the base coupling part 202 is coupled to the bottom surface of the base 120. Further, the leg 210 may be provided on the lower surface of the leg coupling part 209 to separate the fixed leg 200 from the ground. The leg 210 may be provided on all four corners of the leg coupling part 209.

The fixed leg body 205 connects between the base coupling part 202 and the leg coupling part 209 and extends in a longitudinal direction to form the height of the height-adjustable desk 100. The height of the fixed leg body 205 may be manufactured by being variously adjusted according to the user's intention and purpose.

Therefore, the lower portion of the height-adjustable desk 100 may be provided with the fixed leg 200, and thus the height-adjustable desk 100 may be used alone, and the height of the top board 110 is adjusted even in the state in which the fixed leg 200 is coupled, and thus the working environment of the user may be variously changed.

Figure 8:
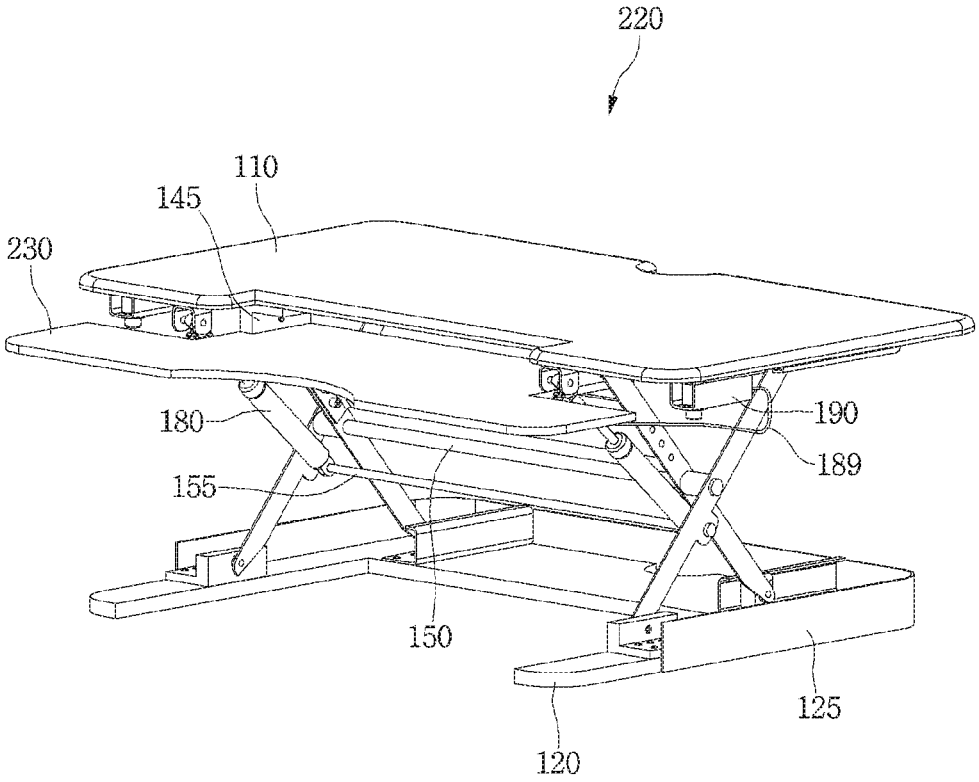
FIG. 8 is a perspective view illustrating a height-adjustable desk according to a second embodiment of the present invention.
Figure 9:
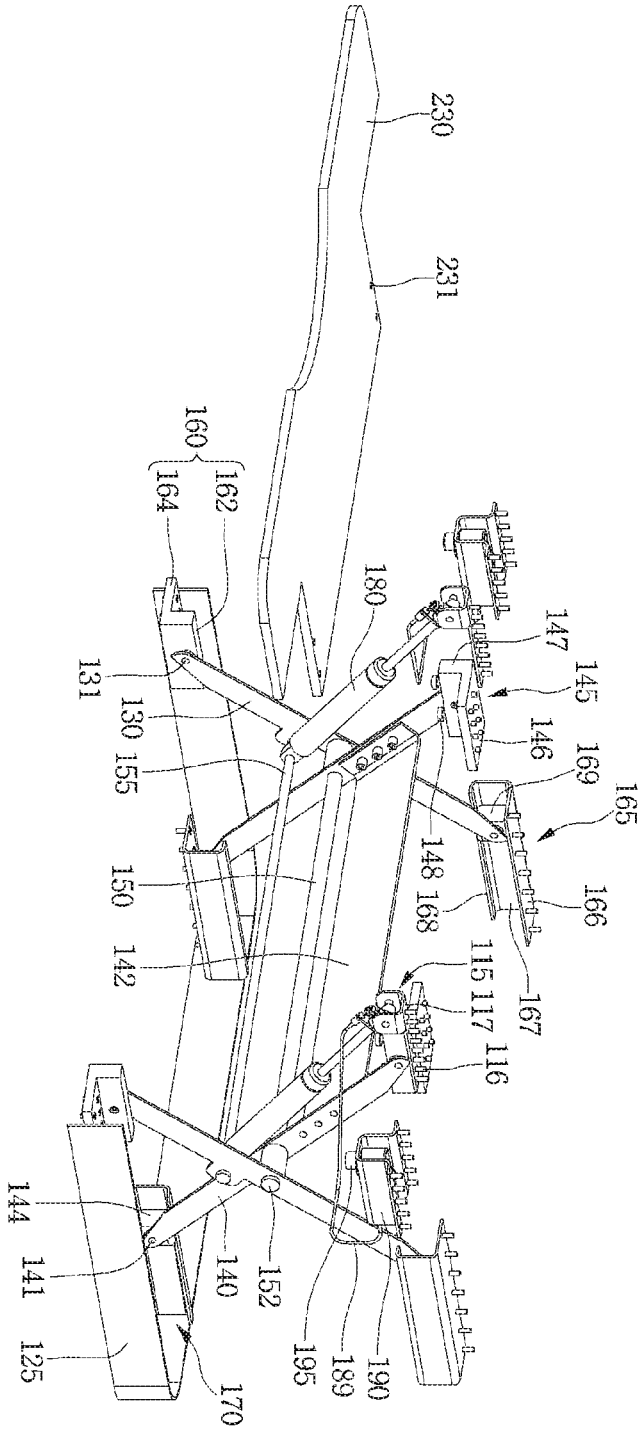
FIG. 9 is a perspective view illustrating an appearance in which an auxiliary support according to the second embodiment of the present invention is separated.

FIG. 8 is a perspective view illustrating a height-adjustable desk according to a second embodiment of the present invention and FIG. 9 is a perspective view illustrating an appearance in which an auxiliary support according to the second embodiment of the present invention moves downward is separated.

The second embodiment has a difference from the first embodiment in the auxiliary support, but other parts of the second embodiment are the same as those of the first embodiment. Therefore, only feature parts of the second embodiment will be described and the same parts as the first embodiment recite the first embodiment.

Referring to FIGS. 8 and 9, a height-adjustable desk 220 according to the second embodiment may be further provided with a plate-shaped auxiliary support 230 disposed under the top board 110. The auxiliary support 230 has an upper surface coupled to a lower surface of the second vertical part 147 of the second coupling part 145.

In detail, the auxiliary support 230 may be provided with link holes 231 passing through the lower surface from the upper surface. The link holes 231 are each formed at both sides while being adjacent to the rear of the auxiliary support 230. Further, a lower surface of the second vertical part 147 is provided with a link groove (not illustrated) so that a link member 148 for coupling the auxiliary support 230 with the second vertical part 147 is fitted.

The auxiliary support 230 may be coupled to the lower surface of the plurality of the second vertical parts 147 disposed at both sides of the lower portion of the top board 110 by link members 148 while the auxiliary support 230 coming into contact therewith so that the link hole 231 and the link groove correspond to each other. In addition, it is possible to more firmly fix the auxiliary support 230 to the lower side of the top board 110 by increasing the number of link holes 231 and link members 148.

Therefore, in the present embodiment, the height-adjustable desk 220 is further provided with the auxiliary support 230 and thus more task tools may be placed thereon. For example, when the computer monitor is disposed on the upper surface of the top board 110, the keyboard may be provided on the upper surface of the auxiliary support 230, and thus a wider free space may be provided on the upper surface of the top board 110.

Meanwhile, the base 120 may be provided with a side wall 125 so that the upper surface of the base 120 is covered along the edge. The side wall 125 is formed to have a height higher than the upper surface of the base 120 to be coupled to the side surface of the base 120. When the side wall 125 is coupled, dust and foreign matters may be prevented from being accumulated on the upper surface of the base 120 and the appearance of the height-adjustable desk 220 may be more refined.

Figure 10:
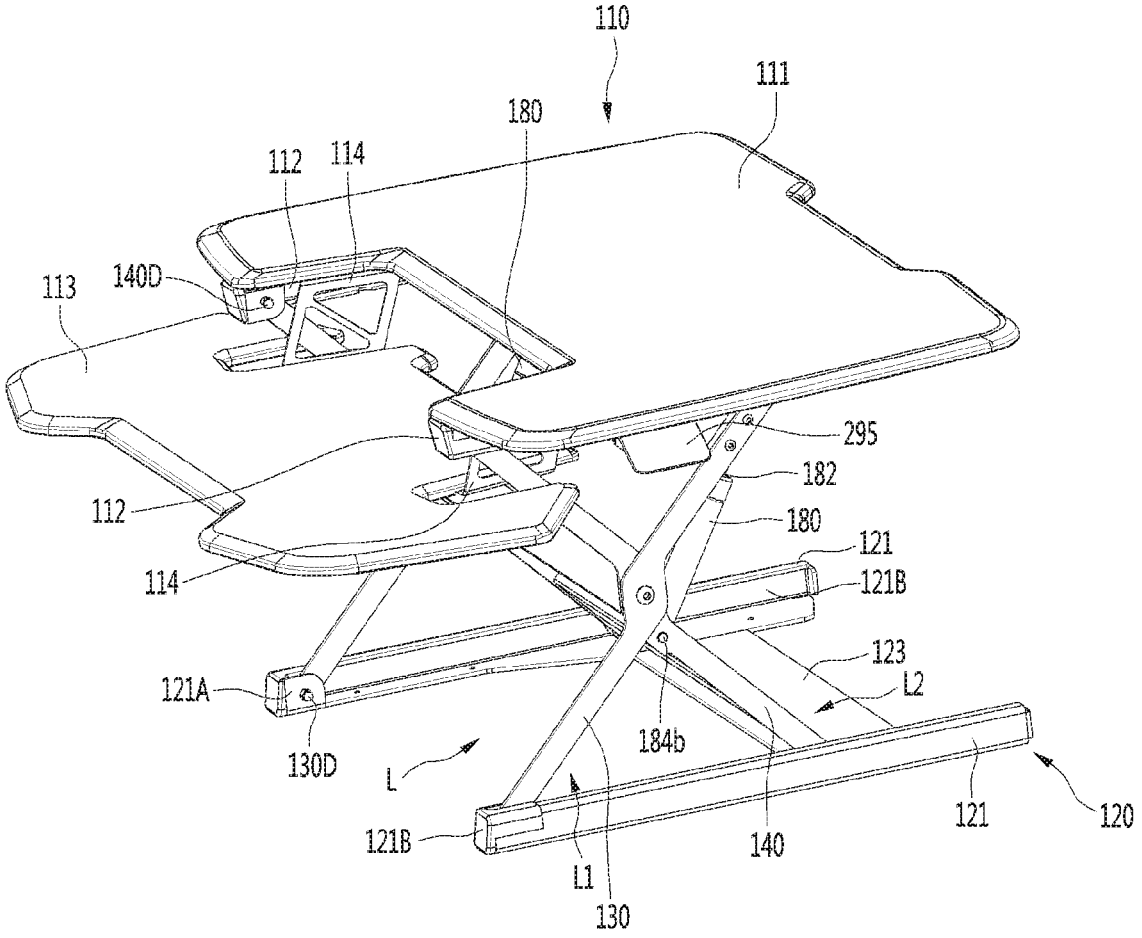
FIG. 10 is a perspective view illustrating a height-adjustable desk according to a third embodiment of the present invention.
Figure 11:
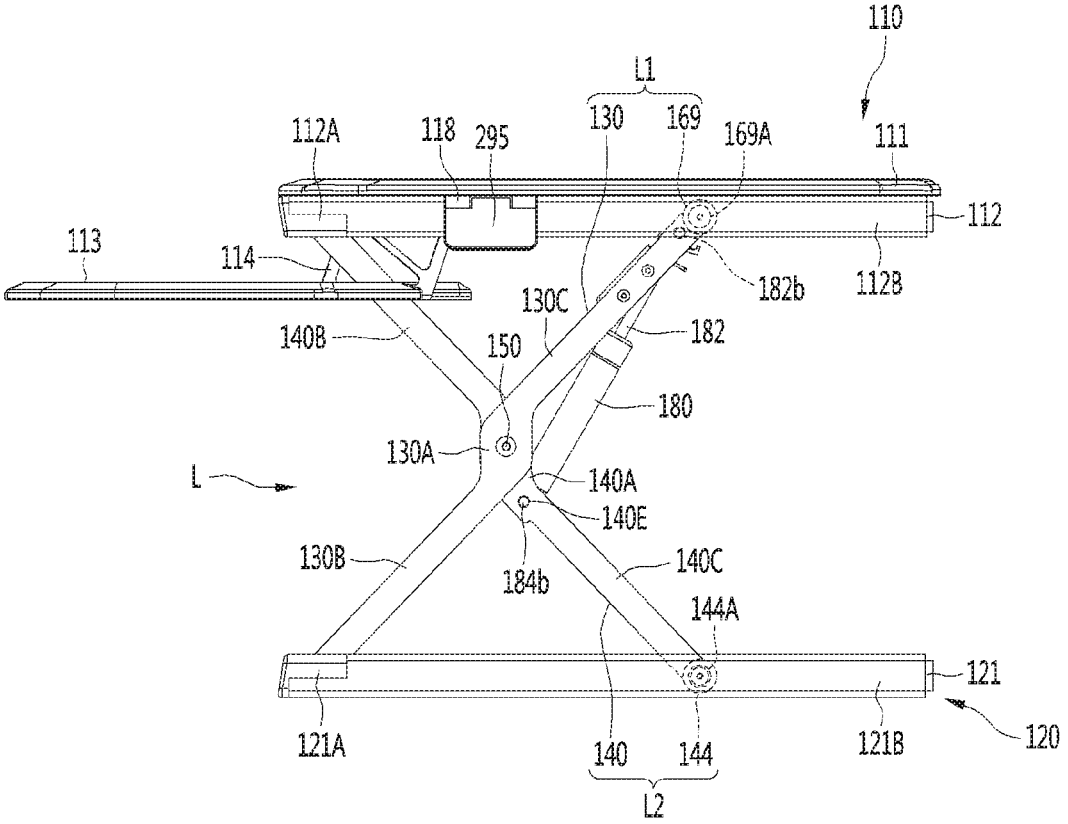
FIG. 11 is a side view of a top board according to the third embodiment of the present invention when the top board rises.
Figure 12:
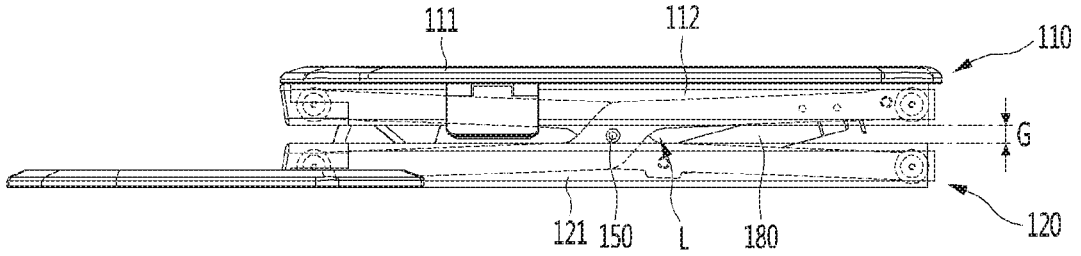
FIG. 12 is a side view of the top board according to the third embodiment of the present invention when the top board falls to a lowest height.

FIG. 10 is a perspective view illustrating a height-adjustable desk according to a third embodiment of the present invention, FIG. 11 is a side view of a top board according to the third embodiment of the present invention when the top board rises, and FIG. 12 is a side view of the top board according to the third embodiment of the present invention when the top board falls to a lowest height.

Referring to FIGS. 10 to 12, the height-adjustable desk includes the base 120, the top board 110, and a link mechanism L disposed between the base 120 and the top board 110 to elevatably support the top board 110.

The top board 110 may include a top plate 111 and an upper frame 112 coupled to a lower portion of the top plate 111.

The top plate 111 may be formed in a plate shape, and a user may place a monitor, a telephone, various documents, etc. on the upper surface of the top plate 111.

A plurality of upper frames 112 may be disposed under the top plate 111. In this case, the plurality of upper frames 112 may be positioned under the top plate 111 to be spaced apart from each other in a left and right direction. The plurality of upper frames 112 may include a left upper frame disposed under the left portion of the top plate 111 and a right upper frame disposed under the right portion of the top plate 111.

The upper frame 112 may be hinged to any one of the pair of links L1 and L2 and may guide the other of the pair of links L1 and L2. The upper frame 112 may be fastened to the top plate 111 so as to be positioned on the bottom surface of the top plate 111. The upper frame 112 may be mounted on the top plate 111 by a fastening member such as a screw and a hanging part such as a hook. The upper frame 112 may include a top board part fastened to the top plate 111 and a side plate part perpendicularly bent at the top board part.

The top board 110 may further include a lower plate 113 spaced apart from the top plate 111. The lower plate 113 may be disposed so as to have a height difference from the top plate 111. The user may place a keyboard, a mouse, or the like on the upper surface of the lower plate 113.

The lower plate 113 may be connected to at least one of the top plate 111 and the upper frame 112 through a plate connector 114. The plate connector 114 may be installed so that the top plate 111 and the lower plate 113 are positioned having a step and the lower plate 113 may be held while being hung by the plate connector 114. The lower plate 113 may be mounted on the lower portion of the plate connector 114 by a fastening member such as a screw or a hanging part such as a hook.

The plurality of plate connectors 114 may be disposed under the top plate 111. The plurality of plate connectors 114 may be positioned under the top plate 111 to be spaced apart from each other in a left and right direction. The plurality of plate connectors 114 may include a left plate connector disposed under the left portion of the top plate 111 and a right plate connector disposed under the right portion of the top plate 111.

The lower plate 113 may be connected to the left plate connector and the right platter connector.

The base 120 may include a lower frame 121. The lower frame 121 may be positioned to be vertically spaced apart from the top board 110. The plurality of lower frames 121 may be disposed to be spaced apart from each other. The plurality of lower frames 121 may include a lower left frame positioned on the lower left portion of the top board 110 and a lower right frame positioned on the lower right portion of the top board 110. The lower left frame and the lower right frame may be positioned to be spaced apart from each other in a left and right direction.

The base 120 may further include a frame connector 123 connecting the plurality of lower frames. The lower left frame and the lower right frame may be connected by the frame connector 123. The lower left frame may be disposed long in a front and rear direction under the top board 110, the lower right frame may be disposed long in a front and rear direction under the top board 110, and the lower left frame and the lower right frame may be spaced apart from each other in a left and right direction. The frame connector 123 may be disposed long in a left and right direction to connect the between lower left frame and the lower right frame, and the left portion may be connected to the lower left frame and the right portion may be connected to the lower right frame.

The link mechanism L may include a left link mechanism for connecting between the lower left frame and the left upper frame, and a right link mechanism for connecting between the lower right frame and the right upper frame.

The link mechanism L may include a pair of links L1 and L2 rotatably connected to the rotating shaft 150. The left link mechanism and the right link mechanism may be configured to have the same structure and may be disposed under the top plate 111 to be symmetrical bilaterally. The left link mechanism and the right link mechanism may each include the pair of links L1 and L2 rotatably connected to the rotating shaft 150. Hereinafter, since the left link mechanism and the right link mechanism have the same structure, they will be referred to as the link mechanism L in order to avoid the redundant description.

At least one of the pair of links L1 and L2 is provided with gap forming parts 130A and 140A that forms a gap G having a predetermined height between the top board 110 and the base 120 when the top board 110 falls to the maximum.

According to the second embodiment, the pair of links L1 and L2 itself may be preferably formed to have the gap having a predetermined height between the top board 120 and the base 110. For this purpose, the pair of links L1 and L2 may be bent at least once.

Each of the pairs of links L1 and L2 has a height difference between both ends by the gap forming parts 130A and 140A. As a result, when the top boards 110 fall to the maximum, one of the top boards 110 may be positioned higher than the other thereof and the top board 110 is not in contact with the base 120 due to the height difference and the gap having a predetermined height may be formed between the top board 110 and the base 120.

Here, each of the pair of links L1 and L2 includes the gap forming parts 130A and 140A, first link parts 130B and 140B disposed to have an obtuse angle with the gap forming parts 130A and 140A and hinged to any one of the base 120 and the top board 110, and second link parts 130C and 140C mounted with moving parts 169 and 144 guided by the other of the base 120 and the top late 110 while having an obtuse angle with the gap forming parts 130A and 140A.

The gap forming parts 130A and 140A may be provided with a rotating shaft through hole through which the rotating shaft 150 rotatably penetrates and the gap forming parts 130A and 140A may be a rotating shaft connection part to which the rotating shaft 150 of the pair of links L1 and L2 is connected.

Here, each of the pair of links L1 and L2 serves as the first and second connection members in the first embodiment. Accordingly, any one or both of the pair of links L1 and L2 is fastened with the height-adjusting mechanism 180 to which the piston rod 182 is connected. The height-adjusting mechanism is the same as that in the first embodiment, and the detailed description thereof will be omitted. However, in the embodiment, the height-adjusting mechanism 180 may be directly connected to the other L2 of the pair of links L1 and L2 without the coupling shaft 155 like the first embodiment. The other L2 of the pair of links L1 and L2 may be provided with a hinge hole 140E on which the hinge shaft 184*b* is rotatably supported.

Meanwhile, in the second embodiment, instead of the button part provided in the first embodiment, an operating lever 295 rotatably connected to the bottom surface of the top board 110 is provided. The operating lever 295 is configured to be connected to the cable of the above-mentioned piston rod 182 to operate the gas opening/closing pin connected to the end of the cable.

Specifically, the operating lever 295 may be rotatably installed on the top board 110 with respect to a horizontal rotating shaft and the cable is operated when the user holds the operating lever 295 to rotate the operating lever 295 upward and thus the height-adjusting mechanism 180 may be operated. To this end, the top board 110 is provided with a horizontal rotating shaft support part 118 for rotatably supporting the horizontal rotating shaft. In FIG. 11, the horizontal rotating shaft support part 118 is provided on the bottom surface of the top board. In some cases, however, the horizontal rotating shaft support part 118 may be provided in either the upper frame 112 or the plate connector 114.

Meanwhile, the upper frame 112 of the top board 110 may be provided with a hinge connection part 112A to which the other one L2 of the pair of links L1 and L2 is hinged and a guide part 112B by which any one L1 of the pair of links L1 and L2 is guided. To this end, the upper frame 112 of the top board may be formed in a front and rear direction. Here, the hinge connection part 112A may be configured to correspond to the second coupling part 145 of the first embodiment of the present invention and the guide part 112B may be configured to correspond to the first slide guide 165 of the first embodiment of the present invention.

The lower frame 121 of the base 120 may be provided with a hinge connection part 121A to which any one L1 of the pair of links L1 and L2 is hinged and a guide part 121B by which the other L2 of the pair of links L1 and L2 is guided. To this end, the lower frame 112 of the base 120 may be formed in a front and rear direction. Here, the hinge connection part 121A may be configured to correspond to the first coupling part 160 of the first embodiment of the present invention and the guide part 121B may be configured to correspond to the second slide guide 170 of the first embodiment of the present invention.

The operation of the second embodiment will be described as follows.

First, the user may hold the operating lever 295 by hand and lift it upwards, such that the operating lever 295 may rotate upward with respect to the horizontal rotating shaft supported by the horizontal rotating shaft support part 118. When the operating lever 295 rotates, the cable connected to the operating lever 295 keeps the piston rod in the movable state as described in the first embodiment, thereby adjusting the height of the top board.

For example, when the user intends to lower the height of the top board 110 in the state illustrated in FIG. 11, the height-adjustable desk may be used in the lifted up and fixed state as illustrated in FIG. 11.

When the user intends to lower the height of the top board 110, the user may hold the operating lever 295 by hand and lift it upwards, such that the piston rod is shifted in the movable state. Thereafter, when the user presses the top board, the top board starts to fall.

At this point, the first link L1 and the second link L2 may stop at the position where the gap G having a predetermined height is formed between the top board 110 and the base 120 as illustrated in FIG. 12, such that the gap is formed between the top board 110 and the base.

As a result, the user's finger may be prevented being caught between the top board 110 and the base 120 due to carelessness during the falling and the safety accident where the user's finger from being caught between the top board 110 and the base 120 may be prevented.

Here, the gap forming member is not necessarily limited to the illustrated shape, and therefore may be modified to have any shape. For example, the height-adjustable desk may include a spacer provided on any one of the top board 110 and the base 120 as the gap forming member. That is, the separate spacer comes into contact with the other of the top board 110 and the base 120 to restrict the minimum height of the top board 110, thereby forming the gap G having a desired height between the top board 110 and the base 120.

The spacer may have a shape in which a separate member is attached to one of the pair of links or any one of the top board and the base, and may also have a shape of a projecting part which is integrally formed on one of the pair of links or any one of the top board and the base.

Further, the spacer may be provided as a pair of magnets that apply a repulsive force to each other. That is, a pair of magnets may be disposed on the top board and the base, respectively, to let the same pole face each other, such that the top board may be spaced apart from the base by a magnetic force. Of course, the pair of magnets may be disposed on each of the pair of links, respectively.

Figure 13:
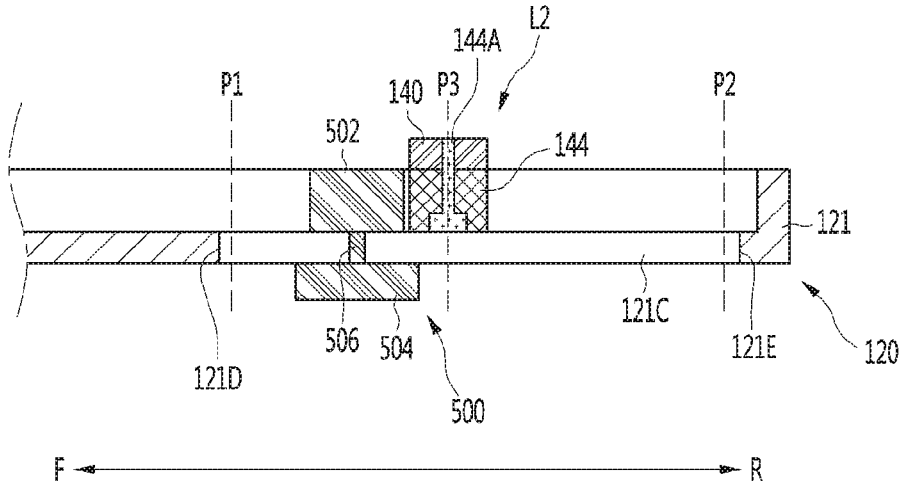
FIG. 13 is a cross-sectional view of a top board according to a fourth embodiment of the present invention when the rising of the top board is limited by a stopper.
Figure 14:
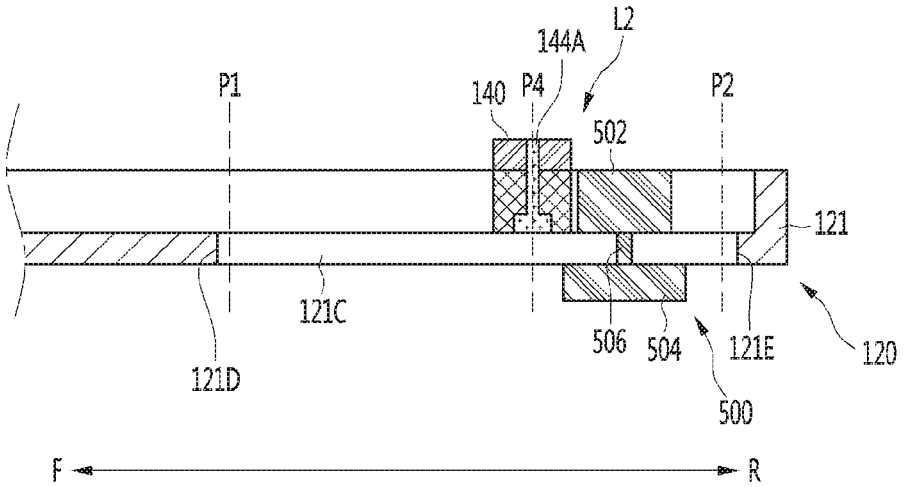
FIG. 14 is a cross-sectional view of the top board according to the fourth embodiment of the present invention when the falling of the top board is limited by the stopper.

FIG. 13 is a cross-sectional view of a top board according to a fourth embodiment of the present invention when the rising of the top board is limited by a stopper and FIG. 14 is a cross-sectional view of the top board according to the fourth embodiment of the present invention when the falling of the top board is limited by the stopper.

In the fourth embodiment, the lower frame 121 may be provided with a stopper 500 to which one L2 of the pair of links L1 and L2 is locked. The position of the stopper 500 may be installed to be variable on a moving path (from P1 to P2) of one of the pair of links L1 and L2. In the fourth embodiment, the configuration and operation other than the stopper 500 are the same as or similar to those of any one of the first to third embodiments of the present invention, and a detailed description thereof will be omitted. For convenience, the same parts of the third embodiment are denoted by the same reference numerals as the third embodiment, and a detailed description thereof will be omitted.

When the stopper 500 is not installed, the moving part 144 of one of the pair of links L1 and L2 may be guided back and forth along the moving path (from P1 to P2) of the lower frame 121.

When the stopper 500 is not installed, the moving part 144 may move to a foremost position P1 which is a position maximally advanced in a forward direction F and a rearmost position P2 which is a position maximally retreated in a backward direction R.

The stopper 500 may be installed on the lower frame 121 so that when the moving part 144 is advanced toward the foremost position P1, as illustrated in FIG. 13, the moving part 144 is constrained prior to reaching the foremost position P1 and the moving part 144 advanced toward the foremost position P1 is locked to the stopper 500 in a forward direction and thus may no longer be advanced forward.

On the contrary, the stopper 500 may be installed on the lower frame 121 so that when the moving part 144 is retreated toward the rearmost position P2, as illustrated in FIG. 14, the moving part 144 is constrained prior to reaching the rearmost position P2 and the moving part 144 retreated toward the rearmost position P2 is locked to the stopper 500 in a backward direction R and thus may no longer be retreated backward.

The stopper 500 may be installed in front of and back of the moving part 144 in the moving direction of the moving part 144 and the actual moving path of the moving part 144 may be changed according to the installation position.

The movable path of the moving part 144 is in between the foremost position P1 and the rearmost position P2. Here, if the stopper 500 is installed in front of the moving part 144 at a position behind the foremost position P1 as illustrated in FIG. 13, the actual movable path of the moving part 144 may be in between a position P3 that is a rear end of the stopper 500 and the rearmost position P2 and if the stopper 500 is installed in back of the moving part 144 at a position in front of the rearmost position P2 as illustrated in FIG. 14, the actual movable path of the moving part 144 may be in between a position P4 that is a front end of the stopper 500 and the foremost position P1.

In the height-adjustable desk, the maximum rising height of the top board 110 may be restricted to be lower than that of the case in which the stopper 500 is not installed and the maximum falling height of the top board 110 may be restricted to be higher than that of the case in which the stopper 500 is not installed.

Meanwhile, the stopper 500 may serve to prevent the moving part 144 from sliding along the lower frame 121 by restricting the moving part 144 and maintain the height of the height-adjustable desk together with the height-adjusting mechanism 180.

The stopper 500 preferably has the structure in which the installation position thereof may be easily changed and preferably has the structure in which it is easily held by hand from the outside of the base 120.

The stopper 500 may include a moving part contacting member 502 that is positioned at the moving path (from P1 to P2) of the moving part 144 to contact the moving part 144 and constrain the moving part 144. The stopper 500 may further include a knob member 504 which may be held by a user to rotate. The knob member 504 may be separately coupled to the moving part contacting member 502 and may be coupled to the moving part contacting member 502 so as to be positioned outside the lower frame 121. The stopper 500 may further include a connection member 506 connecting between the knob member 504 and the moving part contacting member 502. The connection member 506 may be protrudedly mounted on any one of the knob member 504 and the moving part contacting member 502 or may be formed thereon to integrally protrude. In this case, the other of the knob member 504 and the moving part contacting member 502 may be formed with a connection member coupling hole into which at least a part of the connection member 506 is inserted. It is needless to say that the connection member 506 may be fitted in the connection member coupling hole and may be screwed.

The connection member 506 may be disposed on any one of the knob member 504 and the moving part contacting member 502 so as to horizontally protrude.

Meanwhile, the lower frame 121 may be provided with a slit 121C through which the connection member 506 may penetrate. The slit 121C may be formed long in the front and rear direction on the lower frame 121 and the connection member 506 may be formed at a predetermined position between a front end 121D of the slit 121C and a rear end 121E of the slit 121C.

Figure 15:
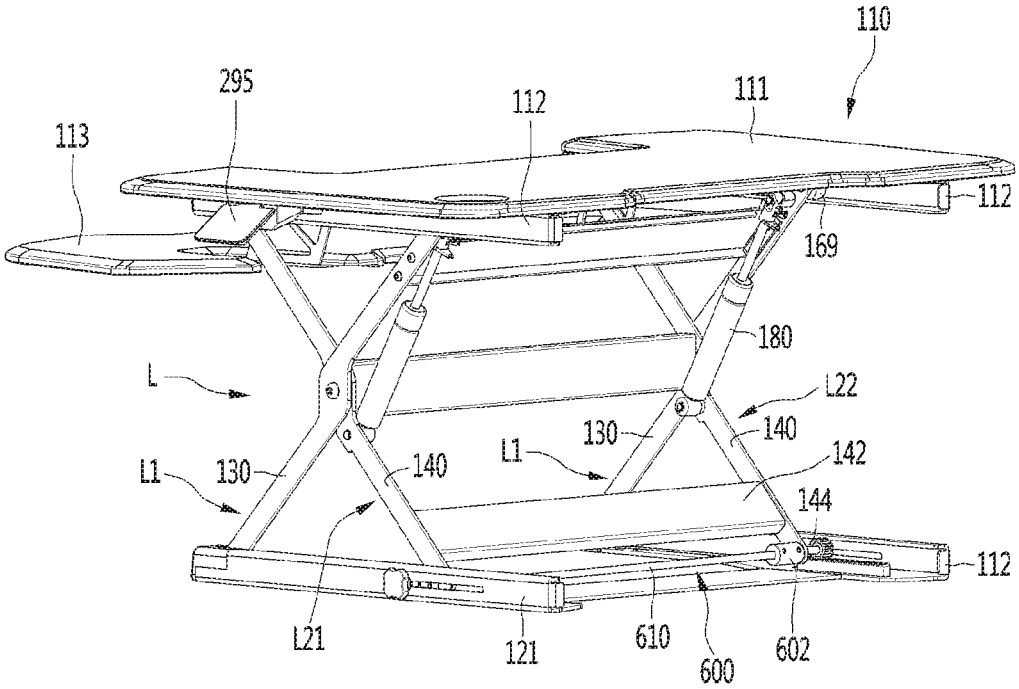
FIG. 15 is a perspective view illustrating a rear side of a height-adjustable desk according to a fifth embodiment of the present invention.
Figure 16:
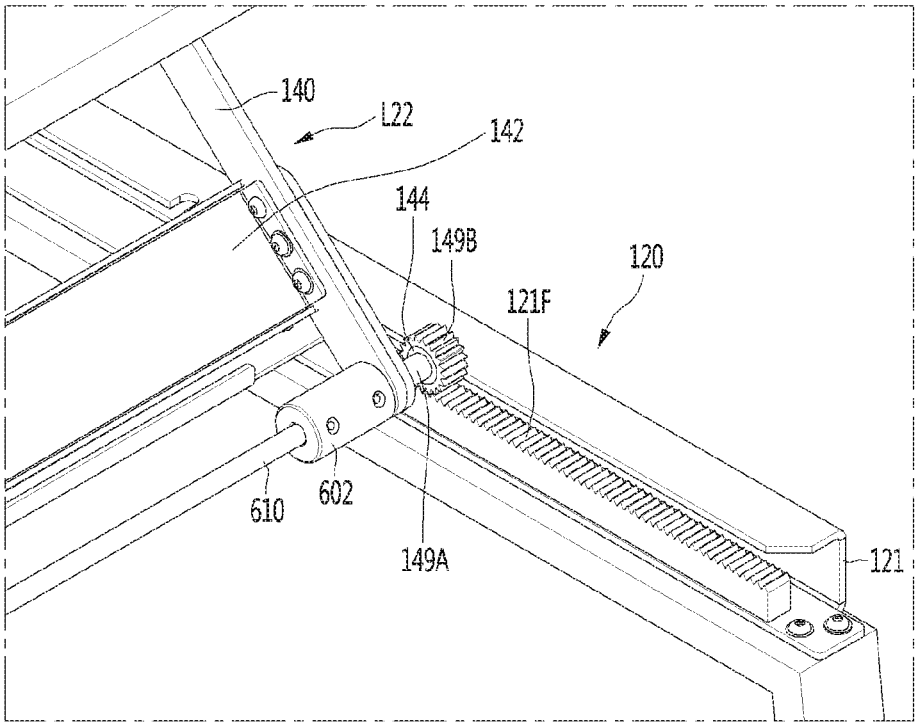
FIG. 16 is an enlarged perspective view illustrating a horizontal holding part according to the fifth embodiment of the present invention.

FIG. 15 is a perspective view illustrating a rear side of a height-adjustable desk according to a fifth embodiment of the present invention and FIG. 16 is an enlarged perspective view illustrating a horizontal holding part according to the fifth embodiment of the present invention.

The heat-adjustable desk according to the fifth embodiment may include the base 120; the top board 110; and the link mechanism L disposed between the base 120 and the top board 110 to elevatably support the top board 110, in which the link mechanism L may include a horizontal holding part 600 that is hinged to any one of the base 120 and the top board 110 and is guided to the other of the base 120 and the top board 110 to move the top board 110 up and down and is connected to be operated while the left link and the right link keeps parallel with each other so that the top board 110 moves up and down while the top board 110 keeps horizontal with the left link and the right link spaced apart from each other in a left and right direction.

Except for the horizontal holding part 600, other parts of the fifth embodiment may be the same as or similar to one of the first to fourth embodiments of the present invention, and the same parts are denoted by the same reference numerals and a detailed description thereof will be omitted. For convenience, the same parts as the third and fourth embodiments are denoted by the same reference numerals as the third and fourth embodiments and the detailed description thereof will be omitted.

Each of the left link and the right link may include the connection member 140 hinged to any one of the base 120 and the top board 110 and the moving part 144 rotatably connected to the connection member 140 to be guided to the other of the base 120 and the top board 110.

The left link of the present embodiment may be a link positioned on the left side of the pair of second links L2 of the third embodiment of the present invention. Hereinafter, for convenience of explanation, the second link will be described using reference numeral L22 different from that of the third embodiment of the present invention.

The right link of the present embodiment may be a link positioned on the right side of the pair of second links L2 of the third embodiment of the present invention. Hereinafter, for convenience of explanation, the second link will be described using reference numerals L21 and L22 different from those of the third embodiment of the present invention.

The horizontal holding part 600 may include a parallel shaft 610 connected to the moving part 144 by a coupler 602. The parallel shaft 610 may be positioned horizontally long between the left link L21 and the right link L22. The parallel shaft 610 may be formed to be shorter than a distance between a lower end of the left link L21 and a lower end of the right link L22. The coupler 602 may include a left coupler connected to a left side of the parallel shaft 610 and a right coupler connected to a right side of the parallel shaft 610. The parallel shaft 610 may be a moving part connector that connects between the moving part 144 of the left link L21 and the moving part 144 of the right link L22 and may prevent any one of the moving part 144 of the left link L21 and the moving part 144 of the right link L22 from being guided while rotating faster than the other thereof, while rotating together with the moving part 144 of the left link L21 and the moving part 144 of the right link L22.

The left end of the parallel shaft 610 may be connected to the left coupler positioned on the right side of the left link L21 and the right end of the parallel shaft 610 may be connected to the right coupler positioned on the left side of the right link L22. In the height-adjustable desk, the left link L21, the left coupler, the parallel shaft 610, the right coupler, and the right link L22 may be ordered in the left and right direction.

The moving part 144 of the left link L21 and the moving part 144 of the right link L22 may be protrudedly provided with a rotation shaft 149A.

The rotating shaft 149A protruding on the moving part 144 of the left link L21 may be connected to the left coupler through the connection member 140 of the left link L21 and the rotating shaft 149A protruding on the moving part 144 of the right link L22 may be connected to the right coupler through the connection member 140 of the right link L22.

If any one of the moving part 144 of the left link L21 and the moving part 144 of the right link L22 rotates, the moving part 144 of the left link L21 and the moving part 144 of the right link L22 may integrally rotate by the coupler 602 and the parallel shaft 610 and the moving part 144 of the left link L21 and the moving part 144 of the right link L22 may be guided to rotate at the same speed.

When the moving part 144 of the left link L21 and the moving part 144 of the right link L22 rotates at different speeds, the moving part 144 of the left link L21 and the moving part 144 of the right link L22 may be different from each other in the position in the front and rear direction. In this case, the top board 110 may be tilted while being biased to one of the left and right sides.

Meanwhile, as described above, if the moving part 144 of the left link L21 and the moving part 144 of the right link L22 integrally rotate at the same speed by the parallel shaft 610, the top board 110 may move up and down while keeping horizontal on the whole.

The horizontal holding part 600 may include the link connector 142 connected to the left link L21 and the right link L22, respectively. The link connector 142 may connect between the connection member of the left link L21 and the connection member of the right link L22 so that the left link L21 and the right link L22 are operated integrally.

The horizontal holding part 600 may include a pinion gear 149B coupled to rotate together with the moving portion 144 and a rack gear 121F engaged with the pinion gear 149B so that the pinion gear 149B moves forward and backward. Here, the inside of the coupler 602 may be provided with a shock absorbing part for blocking the rotation of the pinion gear, for example, a shock absorbing means, or the like in which oil or the like is sealed. Thereby, the movement or flowing of the moving part may be blocked within a certain level. As a result, the top board may be more stably supported.

The rack gear 121F may be formed on the base 120 or the top board 110 to which the moving part 144 is guided.

The rack gear 121F may be formed long in the front and rear direction on the lower frame 121 and the moving part 144 may be positioned to rotate in the front and rear direction along the rack gear 121F inside the lower frame 121. The pinion gear 149B and the rack gear 121F may prevent the moving part 144 from being twisted in a lateral direction during the rotation of the moving part 144 and the moving part 144 may be moved forward and backward only while minimally shaking.

When the moving part 144 rotates along the rack gear 121F, the pinion gear 149B and the rack gear 121F may help more smoothly rotate the moving part 144 while being prevented from being twisted in the lateral direction of the moving part 144. The top board 110 may smoothly move up and down on the whole.

The horizontal holding part 600 may keep the top board 110 horizontal only using the parallel shaft 610, without the link connector 142, the pinion gear 149B, and the rack gear 121F.

The horizontal holding part 600 may be configured of a combination of the parallel shaft 610, the pinion gear 149B, and the rack gear 121F to keep the top board 110 horizontal, without the link connector 142. In this case, the top board 110 may move up and down while keeping the top board 110 more stably horizontal without shaking.

The horizontal holding part 600 may keep the top board 110 horizontal only using the link connector 142, without the parallel shaft 610, the pinion gear 149B, and the rack gear 121F.

The horizontal holding part 600 may be configured of a combination of the link connector 142, the pinion gear 149B, and the rack gear 121F to keep the top board 110 horizontal, without the parallel shaft 610. In this case, the top board 110 may move up and down while keeping the top board 110 more stably horizontal without shaking.

The horizontal holding part 600 may be configured of a combination of the parallel shaft 610, the link connector 142, the pinion gear 149B, and the rack gear 121F to keep the top board 110 horizontal. In this case, the top board 110 may move up and down while keeping the top board 110 most stably horizontal.

Figure 17:
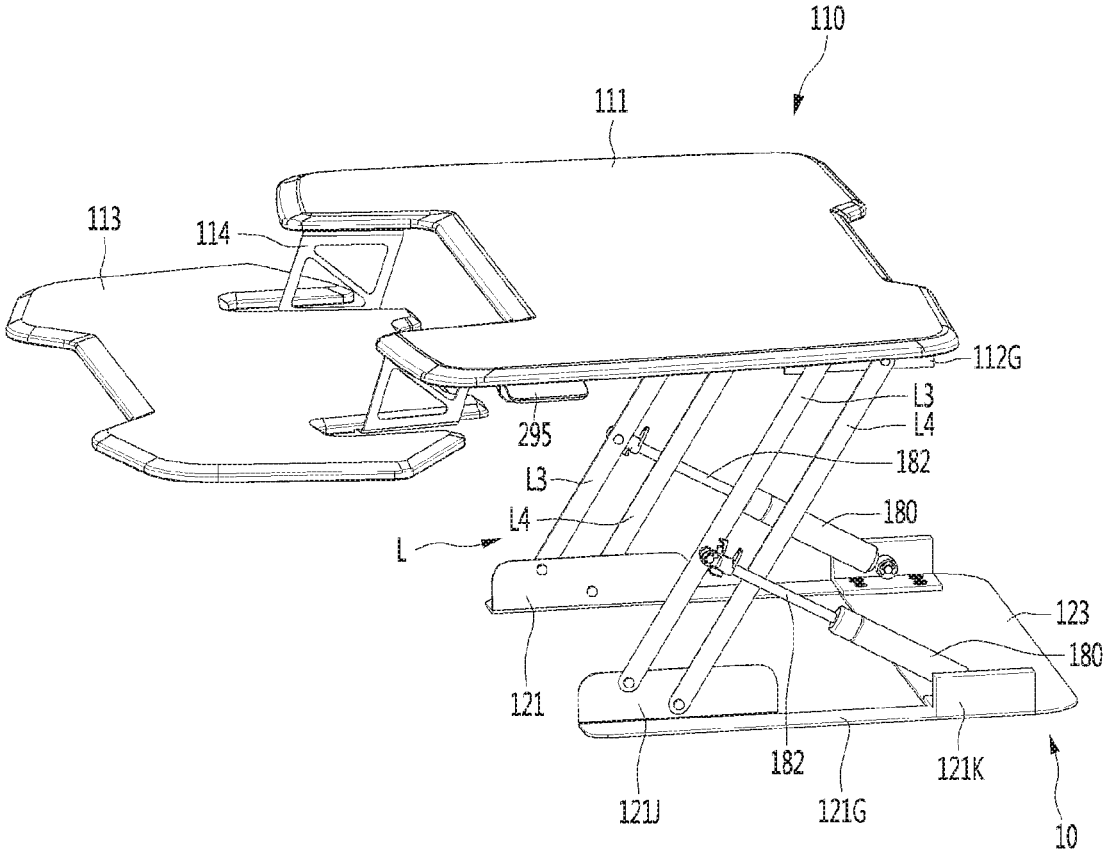
FIG. 17 is a perspective view illustrating a height-adjustable desk according to a sixth embodiment of the present invention.

FIG. 17 is a perspective view illustrating a height-adjustable desk according to a sixth embodiment of the present invention.

In the sixth embodiment, the height-adjustable desk includes the base 120; the top board 110; and the link mechanism L disposed between the base 120 and the top board 110 to elevatably support the top board 110, in which the link mechanism L includes a pair of links L3 and L3 that are spaced from each other in a front and rear direction between the base 120 and the top board 110 and are disposed in parallel with each other. In the sixth embodiment, the height-adjustable desk may further include the height-adjusting mechanism 180 that is rotatably connected to the base 120 and has the piston rod 182 connected to one of the pair of links L3 and L4.

In the sixth embodiment, the height-adjustable desk may include the pair of left links between the left portion of the base 120 and the left portion of the top board 110 and the left height-adjusting mechanism to which the piston rod connected to one of the pair of left links is connected. In the sixth embodiment, the height-adjustable desk may include the pair of right links between the right portion of the base 120 and the right portion of the top board 110 and the right height-adjusting mechanism to which the piston rod connected to any one of the pair of right links is connected.

The two sets of the pair of links L3 and L4 and the height-adjusting mechanism 180 may be disposed to be spaced apart from each other in the left and right direction between the base 120 and the top board 110.

The base 120 may include the lower frame. The base 120 may include the lower left frame and the lower right frame and the lower left frame and the lower right frame may be connected to each other by the frame connector 123.

The lower left frame and the lower right frame may each be disposed long in the front and rear direction and may be disposed in parallel with each other. The lower left frame and the lower right frame are symmetrical bilaterally, and the same configuration will be referred to as the lower frame.

The lower frame may include a lower plate part 121G formed long in the front and rear direction, a lower connection part 121J to which each of the pair of links L3 and L4 is connected, and a height-adjusting mechanism connection part 121K to which the height-adjusting mechanism 180 is hinged.

The lower connection part 121J may be formed perpendicularly to the front portion of the lower plate 121G. Further, the height-adjusting mechanism connection part 121K may be bent perpendicularly to the rear portion of the lower plate part 121G or the frame connector 123.

The top board 110 may include the upper frame. The upper frame may be disposed under the top plate 111 in the top board 110. The upper frame may include an upper connection part 112G to which each of the pair of links L3 and L4 is connected.

The lower portions of the pair of links L3 and L4 may be connected to the lower connection part 121J while being spaced apart from each other. The lower portions of the pair of links L3 and L4 may be rotatably connected to the lower connection part 121J with respect to different hinge shafts. The upper portions of the pair of links L3 and L4 may be connected to the upper connection part 112G. The upper portions of the pair of links L3 and L4 may be rotatably connected to the upper connection part 112G with respect to different hinge shafts.

The pair of links L3 and L4 may guide the top board 110 while rotating the same slope along the top board 110 when the top board 110 moves up and down.

The lower portion of the height-adjusting mechanism 180 may be hinged to the height-adjusting mechanism connection part 121K and the piston rod 182 may be hinged to one of the pair of links L3 and L4. The height-adjusting mechanism 180 may be advanced in the direction in which the piston rod 182 directs to one of the pair of links L3 and L4 while being inclined in the direction toward approximately the front upper side when the top board 110 rises.

The height-adjusting mechanism 180 may be retreated in the direction in which the piston rod 182 is inserted into the height-adjusting mechanism 180 while the piston rod 182 is disposed in substantially a horizontal direction when the top board 110 falls.

Like the third embodiment of the present invention, the sixth embodiment may maintain the position of the top board 110 by operating the height-adjusting mechanism 180 when the operating lever 295 is operated.

Figure 18:
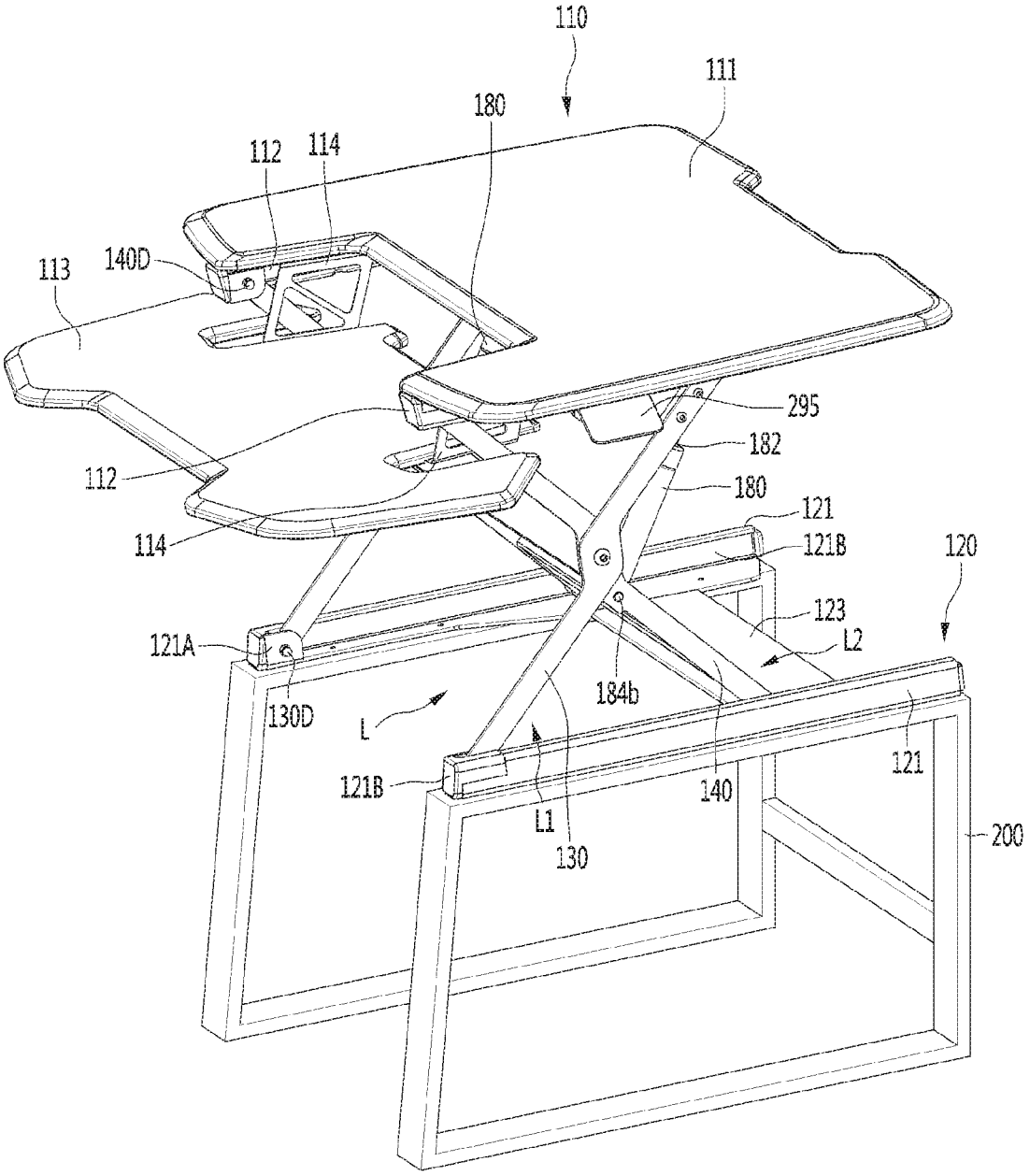
FIG. 18 is a perspective view illustrating a height-adjustable desk according to a seventh embodiment of the present invention.

FIG. 18 is a perspective view illustrating a height-adjustable desk according to a seventh embodiment of the present invention.

The height-adjustable desk according to the seventh embodiment of the present invention may further include the fixed leg 200 supporting the base 120. The base 120 may be installed on the fixed leg 200 and fixed to the fixed leg 200.

The base 120 may be positioned to be spaced apart from the ground by the fixed leg 200. The base 120 may be fixed to the fixed leg 200 by a fastening member such as a screw or a hanging part such as a hook.

The fixed leg 200 may be a part of the height-adjustable desk and may serve as the lower frame or the leg. In the seventh embodiment, the fixed leg 200 may configure the height-adjustable desk together with the base 120, the top board 110, and the link mechanism L. In this case, the height-adjustable desk may be a kind of table desk.

Figure 19:
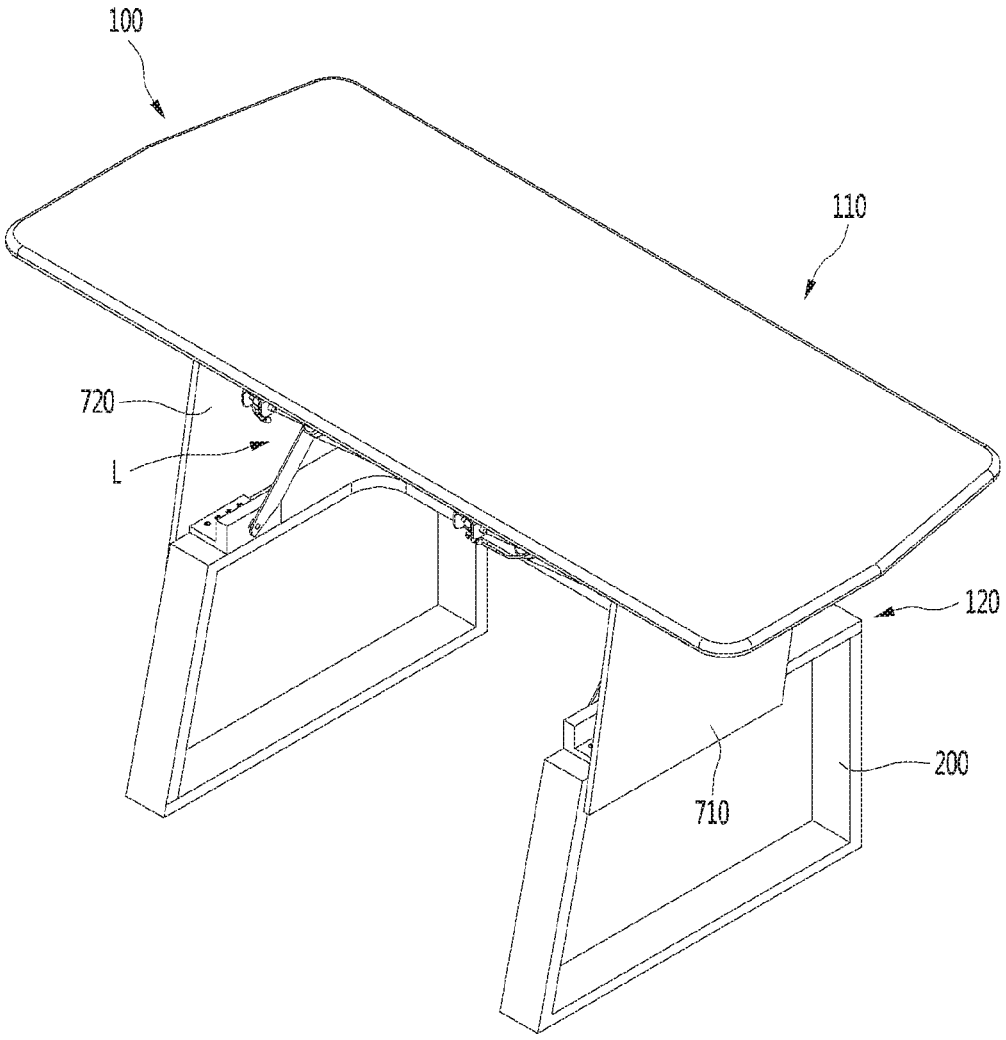
FIG. 19 is a perspective view illustrating a height-adjustable desk according to an eighth embodiment of the present invention when a top board rises.
Figure 20:
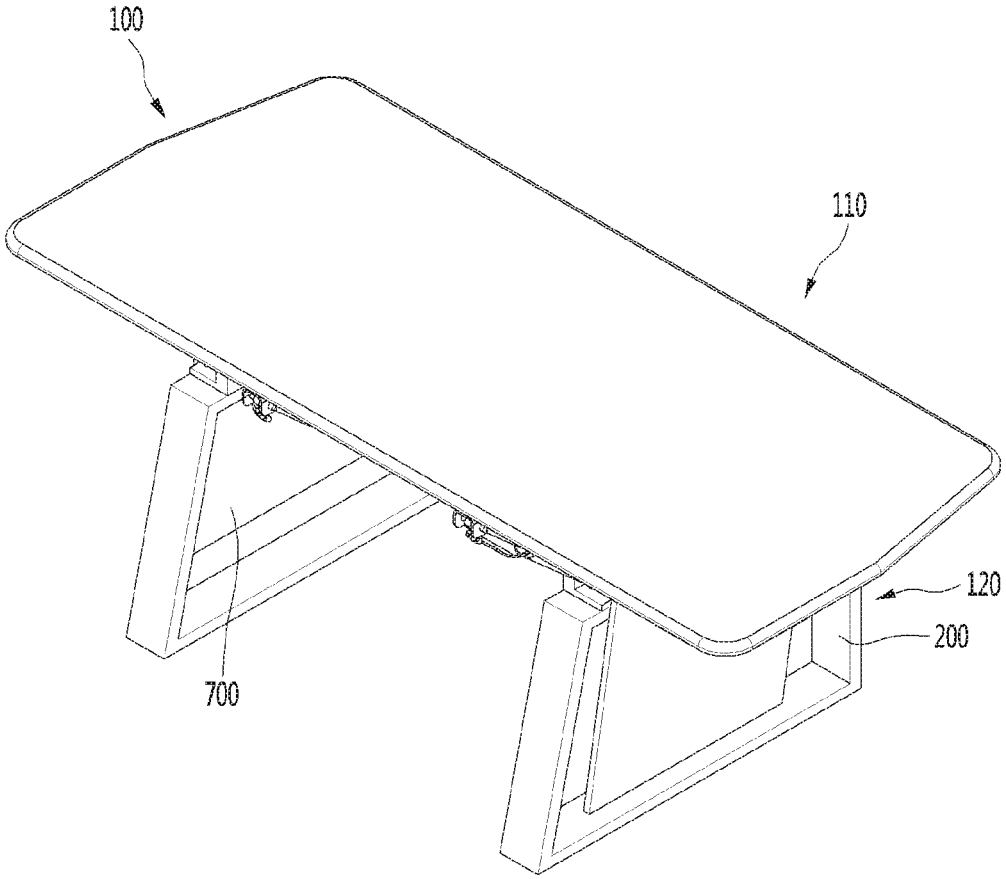
FIG. 20 is a perspective view illustrating the height-adjustable desk according to the eighth embodiment of the present invention when the top board falls.

FIG. 19 is a perspective view illustrating a height-adjustable desk according to an eighth embodiment of the present invention when a top board rises and FIG. 20 is a perspective view illustrating the height-adjustable desk according to the eighth embodiment of the present invention when the top board falls.

The height-adjustable desk 100 of the embodiment may be used as a dining table. The height-adjustable desk 100 includes a left safety cover 710 which is installed on the lower side of the top board 110 to cover the left side of the link mechanism L and a right safety cover 720 which is installed on the lower side of the top board 110 to cover the right side of the link mechanism L.

Each of the left safety cover 710 and the right safety cover 720 may have its upper end fixed to the top board 110 by a fastening member such as a screw or a hanging member such as a hook.

A height of each of the left safety cover 710 and the right safety cover 720 may be made to be higher than the height of the link mechanism L when the link mechanism L is maximally unfolded. Each of the left safety cover 710 and the right safety cover 720 may be formed at a height covering a vicinity of a border of the base 120 and the fixed leg 200.

The left safety cover 710 and the right safety cover 720 may fall together with the top board 110 when the top board 110 falls.

The left safety cover 710 prevent a user's hand such as an infant from being entered between the pair of links from the left side of the left safety cover 710 and the right safety cover 720 may prevent the user's hand such as an infant from being entered between the pair of links from the right side of the right safety cover 720, thereby improving the safety of the height-adjustable desk 100.

Here, the safety cover is not necessarily limited to the illustrated form and therefore instead of the safety cover, any type of plate or sheet, or the like that may cover the side or front, rear, left, and right sides of the link mechanism may be included. In addition, as the safety cover, a curtain film known as a so-called 'blind', that is, a film which is stored while being rolled in a roll form and is drawn out to the outside if necessary may be adopted.

In the eighth embodiment, other configurations and operations of the base 120, the top board 110, the link mechanism L, and the like are the same as or similar to any of third to tenth embodiments of the present invention, and therefore the same reference numerals are used and the detailed description thereof will be omitted. Further, the left and right safety covers may be applied to the embodiments described above.

Figure 21:
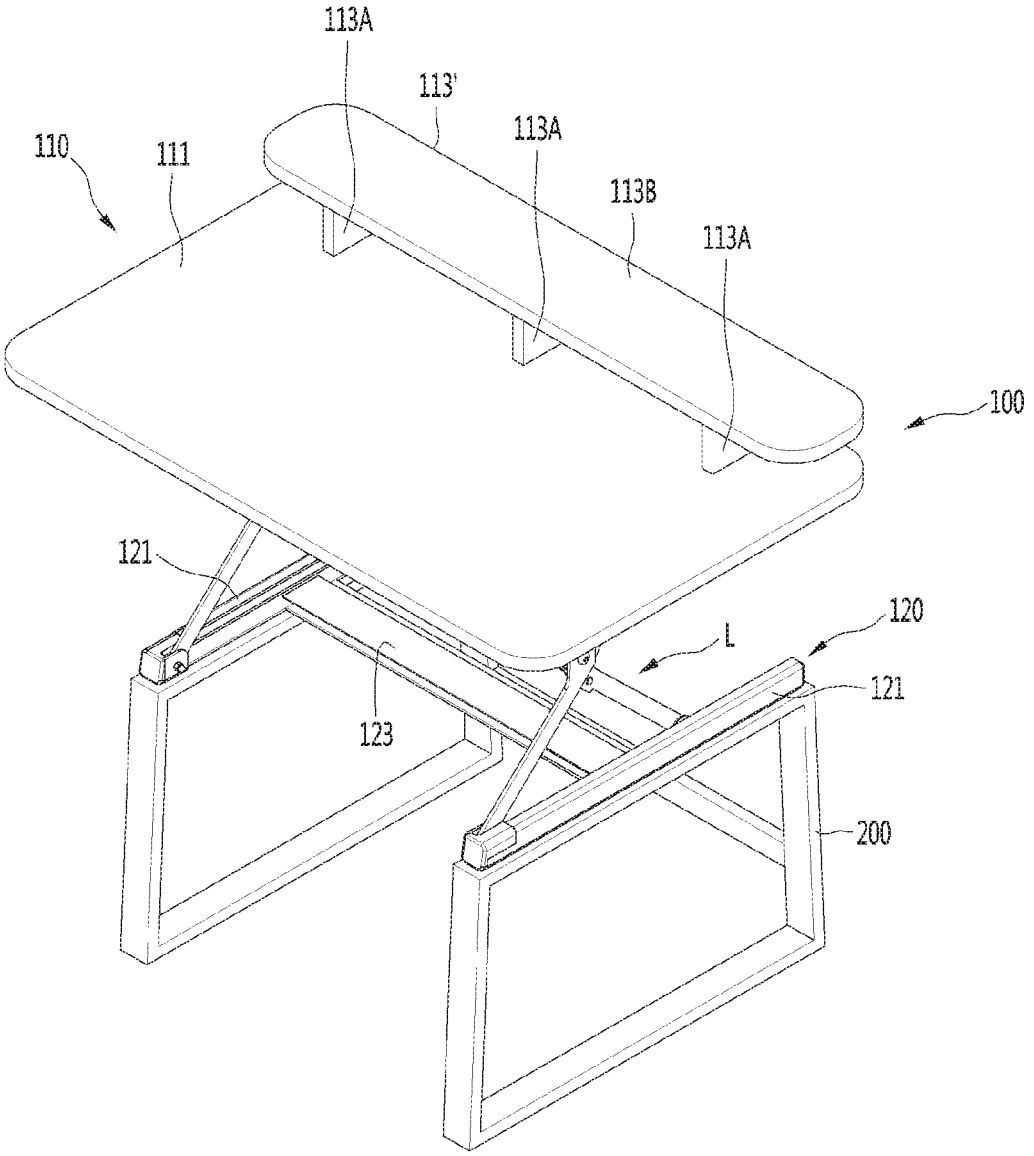
FIG. 21 is a perspective view illustrating a height-adjustable desk according to a ninth embodiment of the present invention.
Figure 22:
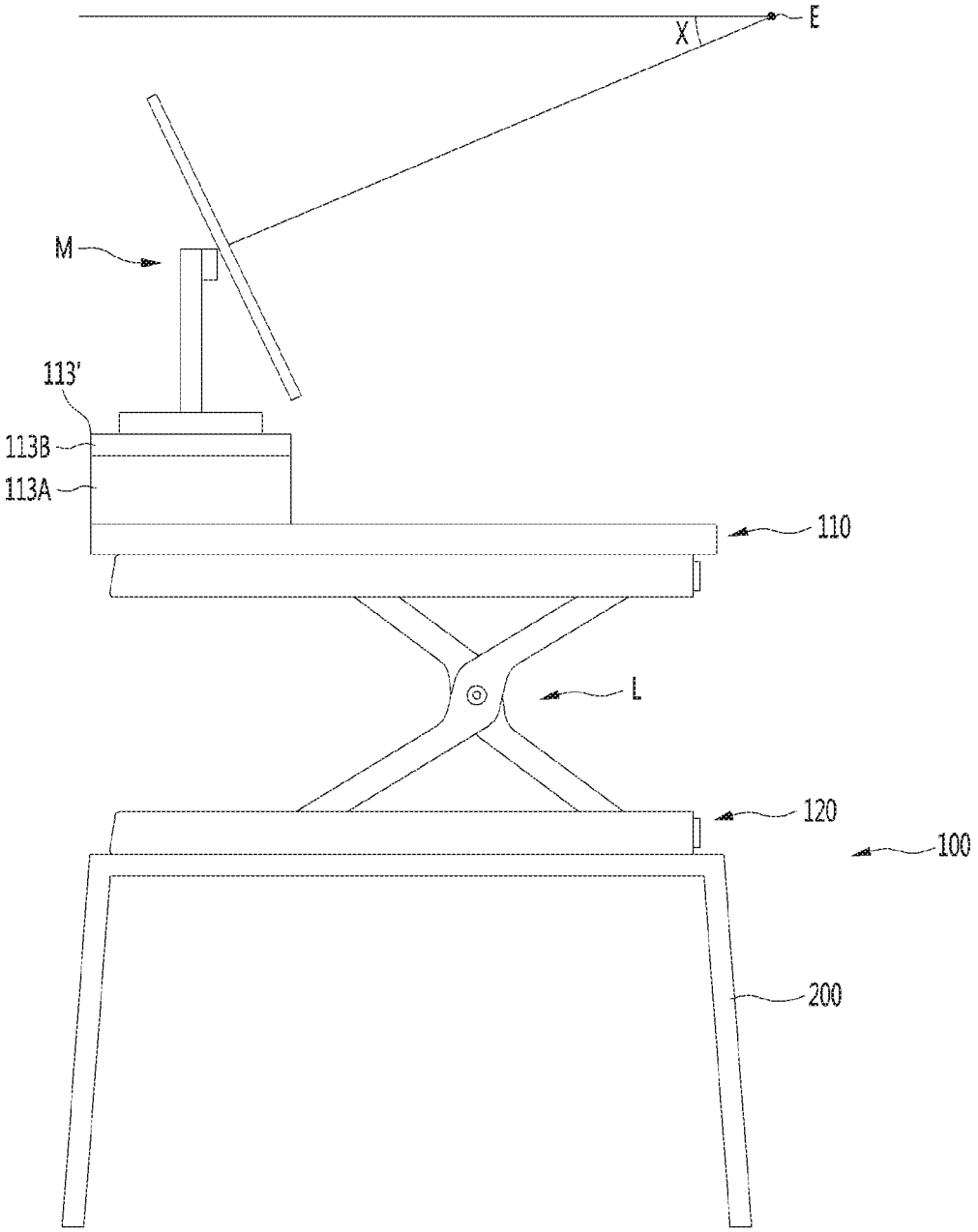
FIG. 22 is a side view illustrating the height-adjustable desk according to the ninth embodiment of the present invention.

FIG. 21 is a perspective view illustrating a height-adjustable desk according to a ninth embodiment of the present invention and FIG. 22 is a side view illustrating the height-adjustable desk according to the ninth embodiment of the present invention.

The height-adjustable desk 100 may include: the fixed leg 200; the base 120 disposed above the fixed leg 200; the top board 110 spaced apart from the base 120; and the link mechanism L connected to the base 120 and the top board 110 to elevatably support the top board 110 and the top board 110 includes the top plate 111 and an auxiliary support 113' disposed above the top plate 111 and having a size smaller than the top plate 111.

The auxiliary support 113' may include a plurality of vertical plates 113A and a horizontal plate 113B disposed in parallel with the top plate 111 above the plurality of vertical plates 113A.

The user may place a monitor M, various books, or the like on the auxiliary support 113' and the user may adjust the height of the top board 110 so that he/she may look at the monitor at the best angle, for example, an angle at which a neck is comfortable.

Referring to FIG. 22, an angle downward inclined from a user's eye E toward a center of the monitor M may be appropriate from 20° to 30° in the downward direction of the eye E, and the user may adjust the height of the monitor M by adjusting the height of the top board 110 and may variously change an angle X at which his/her eye E looks at the monitor M than the case of adjusting only a height of a chair on which the user sits.

Meanwhile, in the tenth embodiment illustrated in FIGS. 21 and 22, the top plate 111 and the auxiliary support 113' are not necessarily limited to the illustrated shapes and may have any shape.

Figure 23:
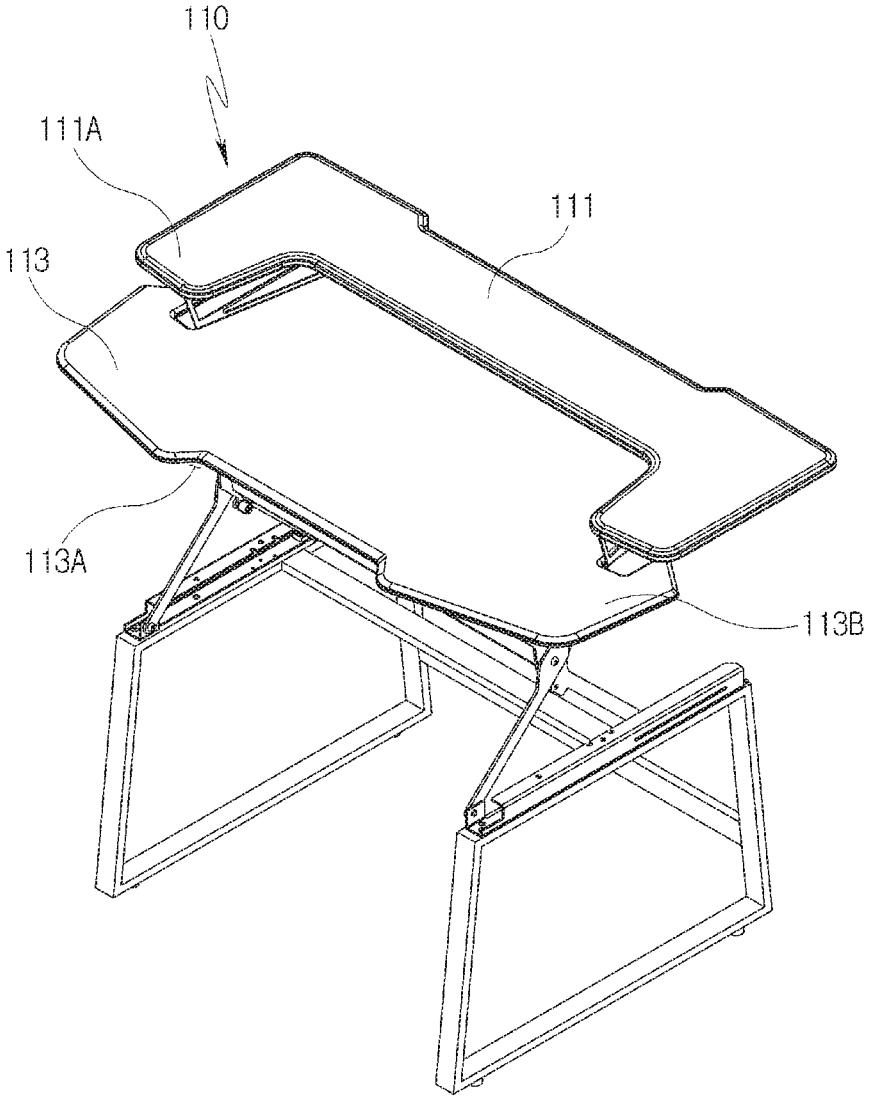
FIG. 23 is a perspective view illustrating a modification example of a tenth embodiment according to the present invention.

FIG. 23 illustrates a form in which the top plate and the auxiliary support in the tenth embodiment are replaced with that of the embodiment illustrated in FIG. 10. Therefore, the example illustrated in FIG. 23 shows that the rest parts except for the top plate and the auxiliary support are basically the same as those of the ninth embodiment.

As illustrated, the top plate has a concave part 113A formed on the front side thereof. The concave part 113A is a part opposed to an abdominal portion of the user and therefore the user may get closer to the auxiliary support where the monitor or the like may be mounted. In addition, wing parts 113B are disposed on both sides of the top plate. The wing part 113B extends laterally from a storage space provided by the top plate and is disposed to be spaced apart from the top board by a predetermined interval.

The interval may provide a space through which the link mechanism, the frame or the like may pass to further reduce the minimum height of the desk.

The auxiliary support has substantially a 'ㄷ'-letter shape in plan view. As a result, both side ends 111A of the auxiliary support protrude toward the front surface of the top plate, and the protruding portion serves to cover the gap between the top plate and the wing part to thereby have a more beautiful appearance and expand the storage space of the auxiliary support.

Figure 24:
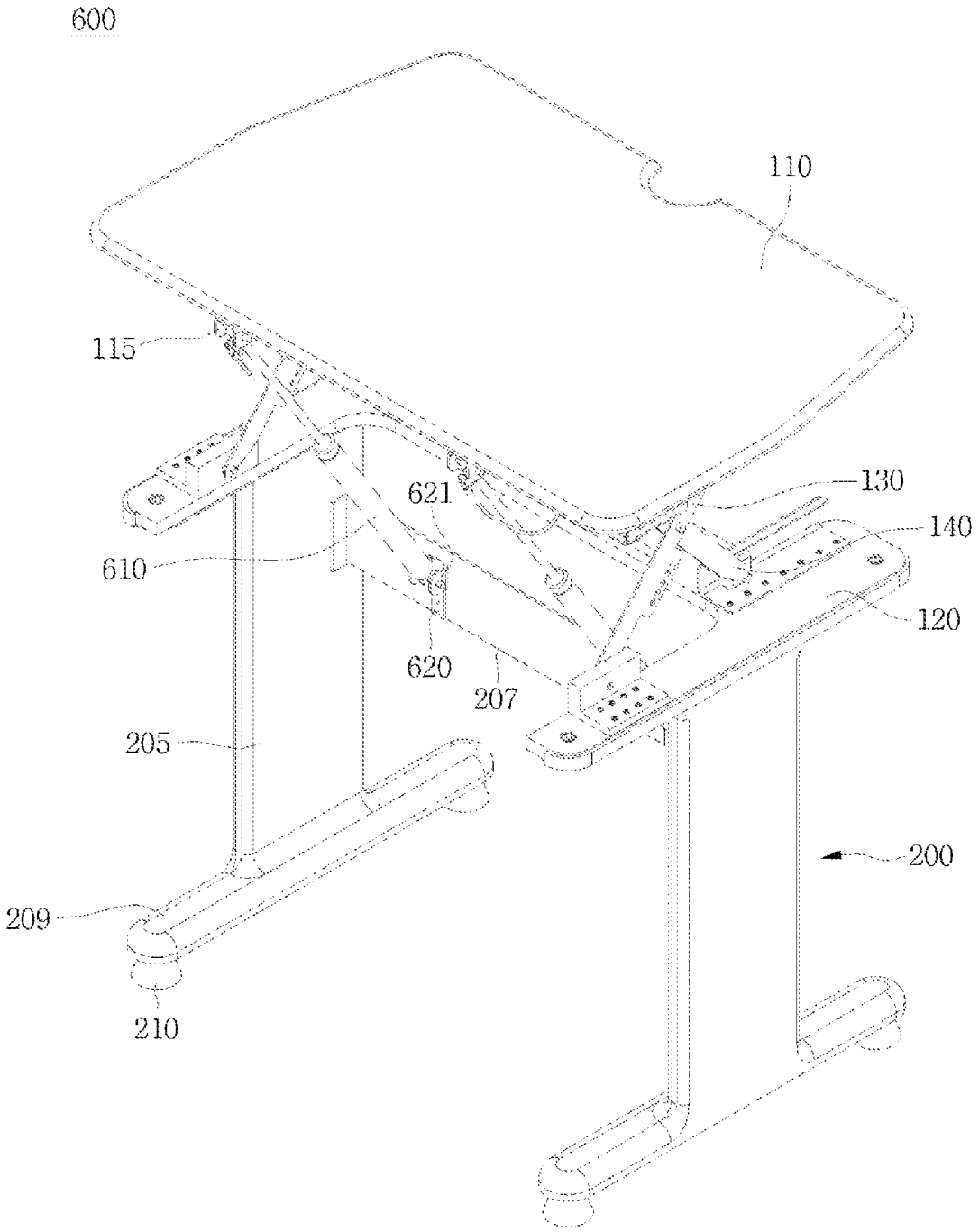
FIG. 24 is a perspective view of a desk according to an eleventh embodiment of the present invention.

FIG. 24 is a perspective view of a desk according to an eleventh embodiment of the present invention.

The eleventh embodiment is different from the first embodiment in a coupling position of a gas spring, but other parts of the eleventh embodiment are the same as those of the first embodiment. Therefore, only feature parts of the second embodiment will be described and the same parts as the first embodiment recite the first embodiment.

Referring to FIG. 24, in a desk 600 according to the eleventh embodiment of the present invention, one end of a gas spring 610 for maintaining the height of the top board 110 is coupled to a gas spring coupling part 115 provided on a lower surface of the front side of the top board 110 and the other end thereof is coupled to a fixing member coupling part 207 of the fixed leg 200.

In detail, describing the difference from the first embodiment, the other end of the gas spring 610 is not coupled to the coupling shaft 155 (see FIG. 1), but is coupled to the fixing member coupling part 207 for maintaining parallelism of the fixed leg 200. For this purpose, a gas spring 610 having a relatively longer length than that of the gas spring of the first embodiment may be employed.

Further, the fixing member coupling part 207 is provided with a connection bracket 620 with which the other end of the gas spring 610 is coupled. One side of the connection bracket 620 is provided with a hinge pin 621 for hinging the other end of the gas spring 610 and the hinge pin 621 may rotate while being hinged to the other end of the gas spring 610. Meanwhile, the action and operation of the gas spring 610 will be described with reference to the first embodiment.

Figure 25:
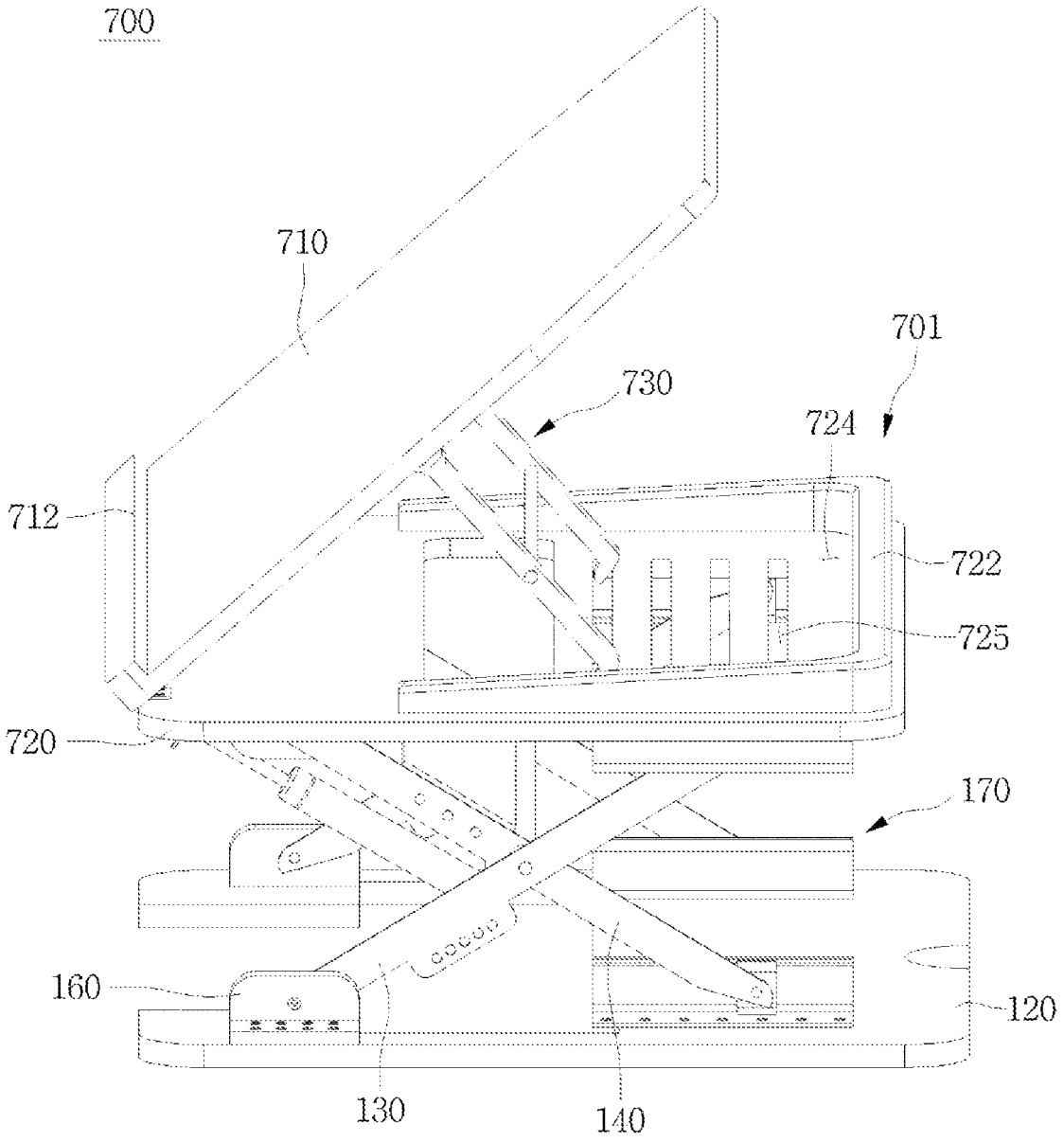
FIG. 25 is a perspective view of a desk according to a twelfth embodiment of the present invention.
Figure 26:
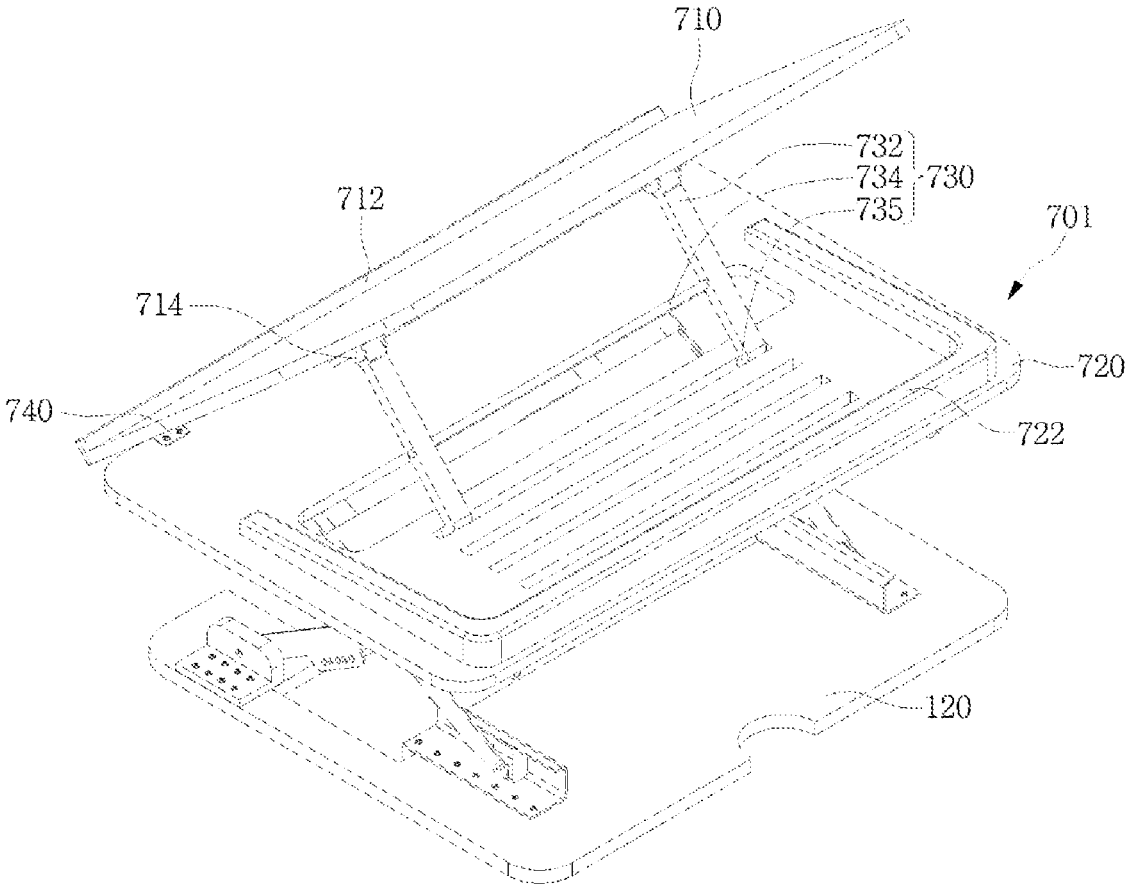
FIG. 26 is a perspective view of the desk of FIG. 25 viewed from different angles.

FIG. 25 is a perspective view of a desk according to a twelfth embodiment of the present invention and FIG. 26 is a perspective view of the desk of FIG. 25 viewed from different angles.

The twelfth embodiment has a difference from the first embodiment in the structure of the top board, but other parts of the twelfth embodiment are the same as those of the first embodiment. Therefore, only feature parts of the second embodiment will be described and the same parts as the first embodiment recite the first embodiment.

Referring to FIGS. 25 and 26, in a desk 700 according to the twelfth embodiment, a top board 701 provided at the upper portion of the base 120 is configured of a plurality of plates, and an angle of which one of the plates is adjusted.

In detail, the top board 701 includes a support part 720 and a rotating part 710 hinged to one end of the support part 720 and relatively rotating so that an angle formed with the support part 720 is changed.

The upper surface of the rotating part 710 is formed with a seating surface on which a book, a notebook or the like is placed, and one side of the seating surface is provided with a stumbling sill 712 whose one surface contacts a book, a notebook, or the like to support the book, the notebook, or the like on the seating surface. That is, the stumbling sill 712 prevents slippage of an object placed on the upper surface of the rotating part 710.

The support part 720 includes a circumferential part 722 forming a seating groove 724 seated with the rotating part 710 by making a part of the circumference of the support part 720 protrude upward and a fitting hole 725 that is formed by penetrating through the upper and lower surfaces of the support part 720 and then has a retaining member 730 to be described below fitted therein.

The support part 720 and the rotating part 710 are each coupled to one side of the upper surface of the support part 720 and one side of the lower surface of the rotating part 710 and are coupled by a hinge part 740 for relatively rotating the rotating part 710. Further, the retaining member 730 for maintaining the rotation state of the rotating part 710 is provided between the rotating part 710 and the support part 720.

The retaining member 730 includes a frame 732 hinged to a hinge coupling part 714 having one end coupled to a back surface of the rotating part 710 and a fitting part 735 fitted in the fitting hole 725 while being formed on the other end of the frame 732 to maintain the rotation state of the rotating part 710 with respect to the support part 720. When the frame 732 is provided in plural, a connection shaft 734 may be additionally provided between the plurality of frames 732 to maintain a parallel state.

Accordingly, the rotating part 710 relatively rotates through the hinge unit 740 with respect to the support part 720, and when the rotation of the rotating part 710 is completed at the user desired angle, the fitting part of the retaining member 730 is fitted in the fitting hole 725 to fix the position of the rotating part 710. Meanwhile, the rotating part 710 may have various angles with respect to the support part 720, and therefore the fitting hole 725 may be formed in plural in the front and rear direction to correspond to the rotation direction of the frame 732.

Accordingly, the user may variously change the angle of the rotating part 710 on which the task tool is placed, and may more conveniently perform work.

Meanwhile, the rotational position of the rotating part 710 may be fixed by the gas spring instead of the retaining member 730.

Figure 27:
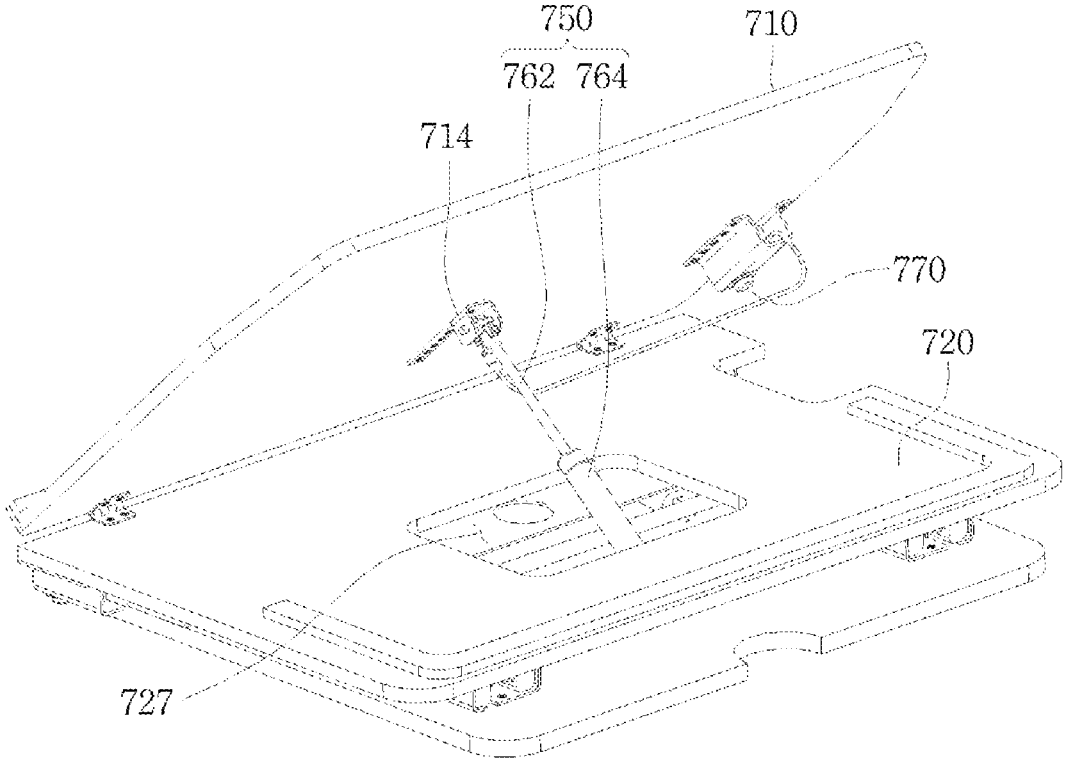
FIG. 27 is a perspective view illustrating an appearance in which a rotating part and a support part are coupled by a first gas spring.

FIG. 27 is a perspective view illustrating an appearance in which a rotating part and a support part are coupled by a first gas spring.

Referring to FIG. 27, as one end of the retaining member 730 is hinged to the rotating part 710 and the other end thereof is coupled to the support part 720 or the base 120 and thus the length thereof is changed, the retaining member 730 may be configured of the gas spring 750 that adjusts the inclination angle of the rotating part 710.

Referring to FIG. 27, the rotational position of the rotating part 710 may be fixed by the first gas spring 750. The first gas spring 750 is a lock type gas spring that adjusts the height of the piston rod 752 by an operation of a button part 770 like the gas spring of the first embodiment. Here, the user operates the button part 770 to adjust the length of the second gas spring 750 and thus the position of the rotating part 710 may be changed while the rotating part 710 forming various angles with the support part 720. Therefore, when the retaining member is configured of the first gas spring 750, the angle of the rotating part 710 may be variously adjusted. In some cases, the gas spring may be changed to a free type gas spring, that is, a type in which the piston rod is not fixed in the middle and is fixed only in two positions where it is minimally expanded and contracted or maximally expanded.

Figure 28:
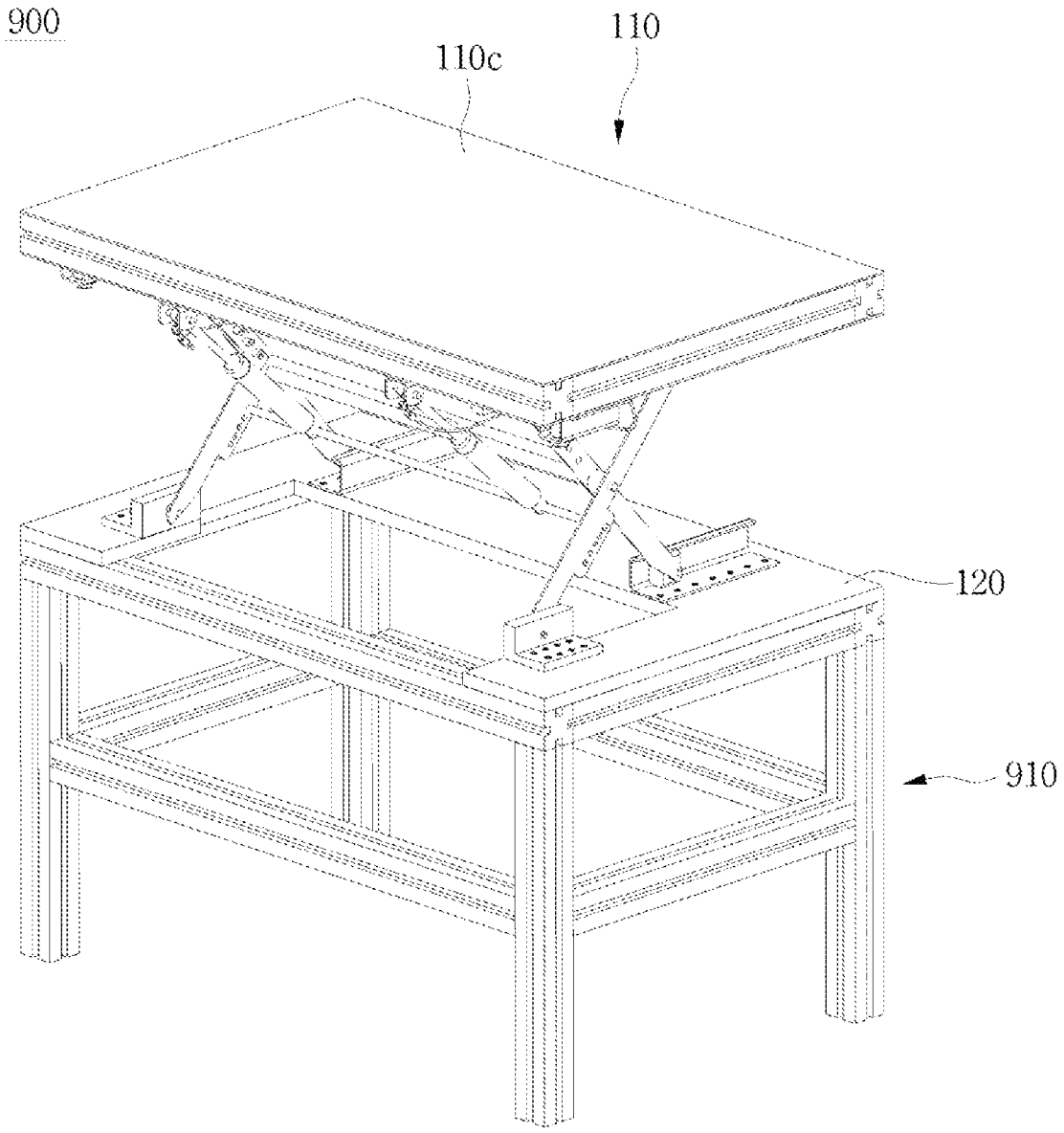
FIG. 28 is a perspective view illustrating a configuration when the desk is used as a work table.

FIG. 28 is a perspective view illustrating a configuration when the desk is used as a work table.

As described above, various tools such as a monitor, a book, and a keyboard may be placed on an upper surface of the top board 110. FIG. 29 illustrates an example in which a desk 900 may be used as a work table on which a vice necessary for machining work is installed and a tool or a workpiece is displayed to perform a manual work. For this purpose, the upper surface of the top board 110 may be surface treated 110*c* with a material stronger than that of a normal desk, and the thickness of the top board 110 may be made thick.

In addition, the lower portion of the top board 110 is provided with a lower structure 910 to support the base 120, so that the top board 110 and the base 120 may be more firmly supported.

Although the height-adjustable desk according to the first to twelfth embodiments has been described above, those skilled in the art may appropriately combine the first to twelfth embodiments, and the combination also falls within the scope of the present invention.

The invention claimed is:

1. A height-adjustable desk, comprising:

a base;

a top board configured to be vertically elevated with respect to the base;

a link mechanism disposed between the base and the top board so as to support the top board such that the top board may be elevated and, the link mechanism including a plurality of link members;

a height-adjusting means formed to be extendable at a desired length and determining a height of the top board with respect to the base according to a length thereof;

an operating means for fixing the height-adjusting means so that the height-adjusting means maintains the desired length; and a cable, wherein the link mechanism includes a pair of first connection members disposed to be spaced apart from each other and a pair of second connection members disposed to be spaced apart from each other, and the first and second connection members are disposed to cross each other;

wherein one end of the first and second connection members is rotatably mounted on any one of the base and the top board, and the other end thereof is slidably mounted on the other of the base and the top board; and wherein the height-adjusting means includes:

a cylinder having a pressure fluid charged therein; and a piston rod slidably mounted on the cylinder and supported only by the pressure fluid charged in the cylinder, wherein an end of the cylinder is connected to the first connection member and an end of the piston rod is connected to the second connection member and wherein the first connection member includes an expanded part where the end of the cylinder is connected, thereby the cylinder is maintained slanted with respect to the base, wherein the operating means includes a lever having one end rotatably mounted on the top board or the link mechanism, wherein the cable has one end connected to the lever and the other end connected to the piston rod, wherein the cable opens and closes a gas channel in the cylinder.

2. The height-adjustable desk of claim 1, wherein the height-adjusting means maintains any one of a state in which the piston rod is movable and a state in which the piston rod is fixed by the operating means.

3. The height-adjustable desk of claim 1, wherein the top board comprises:

a top plate connected to the link mechanism; and a lower plate connected to the top plate.

4. The height-adjustable desk of claim 3, wherein the lower plate includes an area smaller than the top plate.

5. The height-adjustable desk of claim 1, wherein the first connection member or the second connection member includes a gap-forming part bent so that both ends thereof are disposed to be parallel with each other.

6. A height-adjustable desk, comprising:

a base;

a top board configured to be vertically elevated with respect to the base;

a link mechanism disposed between the base and the top board so as to support the top board such that the top board may be elevated, the link mechanism including a plurality of link members;

a height-adjusting means formed to be extendable at a desired length and determining a height of the top board with respect to the base according to a length thereof;

an operating means for fixing the height-adjusting means so that the height-adjusting means maintains the desired length; and a cable;

wherein the link mechanism includes a pair of first connection members disposed to be spaced apart from each other and a pair of second connection members disposed to be spaced apart from each other, and the first and second connection members are disposed to cross each other;

wherein one end of the first and second connection members is rotatably mounted on any one of the base and the top board, and the other end thereof is slidably mounted on the other of the base and the top board; and wherein the height-adjusting means includes:

a cylinder having a pressure fluid charged therein; and a piston rod slidably mounted on the cylinder and supported only by the pressure fluid charged in the cylinder, wherein an end of the cylinder is connected to the first connection member and an end of the piston rod is connected to the second connection member, thereby the cylinder is maintained slanted with respect to the base, wherein the operating means includes a lever having one end rotatably mounted on the top board or the link mechanism, wherein the cable has one end connected to the lever and the other end connected to the piston rod, wherein the cable opens and closes a gas channel in the cylinder.

* * * * *